US011305841B1

(12) United States Patent
Haas

(10) Patent No.: US 11,305,841 B1
(45) Date of Patent: Apr. 19, 2022

(54) TRENCH AND PLATE BOAT HULL SYSTEM

(71) Applicant: Benjamin S. Haas, Ottsville, PA (US)

(72) Inventor: Benjamin S. Haas, Ottsville, PA (US)

( * ) Notice: Subject to any disclaimer, the term of this patent is extended or adjusted under 35 U.S.C. 154(b) by 0 days.

(21) Appl. No.: 16/817,476

(22) Filed: Mar. 12, 2020

Related U.S. Application Data

(60) Provisional application No. 62/817,292, filed on Mar. 12, 2019.

(51) Int. Cl.
*B63B 5/24* (2006.01)
*B63B 3/08* (2006.01)

(52) U.S. Cl.
CPC . *B63B 5/24* (2013.01); *B63B 3/08* (2013.01)

(58) Field of Classification Search
CPC ..... B63B 5/24; B63B 3/08
See application file for complete search history.

(56) References Cited

U.S. PATENT DOCUMENTS 3,324,819 A * 6/1967 Tetyak ..... A63B 35/12 440/87
8,292,547 B2 * 10/2012 Johanneck ..... B63B 3/08 405/219
2004/0235406 A1 * 11/2004 Duescher ..... B24D 11/001 451/527
2007/0063378 A1 * 3/2007 O'Donoghue ..... B29C 33/40 264/219
2009/0044740 A1 * 2/2009 Imel ..... B63B 3/08 114/263
2011/0061336 A1 * 3/2011 Thomas ..... E04G 21/16 52/745.19
2017/0144359 A1 * 5/2017 Darling ..... B29C 51/10

OTHER PUBLICATIONS https://polycraft.com/410-challenger, Polycraft USA 410 Challenger, 6 pages, accessed Feb. 1, 2022, est. publication Oct. 2020 (Internet archive).
https://polycraft.com/530-warrior, Polycraft Our Boats 530 Warrior, 7 pages, accessed Feb. 1, 2022, est. publication Oct. 2020 (Internet archive).
https://www.freedomelectricmarine.com/collections/boat-models-ii/products/copy-of-twin-troller-x10-deluxe-boat, Twin Trailer The Ultimate Small Fishing Boat, 7 pages, accessed Feb. 1, 2022, est. publication Apr. 2021 (Internet archive).
https://www.rigiflex.net/en/angling-boats/aqua-bass-boat-370/, Rigiflex Aqua Bass Boat 370, 12 pages, accessed on Feb. 1, 2022, est. publication unknown.

* cited by examiner

*Primary Examiner* — S. Joseph Morano
*Assistant Examiner* — Jovon E Hayes
(74) *Attorney, Agent, or Firm* — Wilkinson Law Office; Clinton H. Wilkinson

(57) ABSTRACT

An article of manufacture involving a system of molded-in cavities and post-molded cover plates that solve a multitude of problems in applying rotational molding to the construction of plastic-hulled power boats. The article of manufacture includes a body, wherein the body is a plastic molded boat hull comprised of numerous molded-in cavities and molded-in features to create an interior layout that is comparable to a conventional boat built of aluminum or fiber reinforced plastic.

20 Claims, 25 Drawing Sheets

TRENCH AND PLATE BOAT HULL SYSTEM

CROSS-REFERENCE TO RELATED APPLICATION

This application claims the benefit of U.S. Provisional Patent Application Ser. No. 62/817,292 filed on Mar. 12, 2019, the entirety of which is now incorporated herein by reference.

FIELD OF THE INVENTION

The present invention relates to systems and methods for the construction of rotational molded plastic-hulled power boats, and more particularly to a trench and plate boat hull system including a combination of numerous molded-in trench-like male cavities, kiss-offs and other features strategically located throughout the boat and corresponding cover plates which are secured over these features so as to be flush with the surrounding plastic and/or not interfere with surrounding boat structures.

BACKGROUND OF THE INVENTION

In the pursuit of applying rotational molding to the construction of plastic-hulled power boats, there are certain unique problems inherent to rotational molding that must be surmounted in order to make rotationally-molded plastic-hulled power boats that can compete on quality, performance, and price with conventional power boats constructed of aluminum, or fiber reinforced plastic (FRP). Among these problems are the following:

1) How to run electrical cables, hoses, and other conduits throughout the boat in a clean and efficient manner without resorting to cutting open the molded plastic shell, without using molded-in rigging tubes, and without using a complex pre-fabricated deck, so as to achieve a layout and appearance comparable to that of a conventional boat built of aluminum or FRP;
2) How to install industry standard equipment that requires a void space beneath the deck or gunwale onto which they are designed to be mounted, such as navigation light fixtures, fuel deck fills, and electrical receptacles without resorting to cutting open the molded plastic shell, without using molded-in rigging tubes, and without using a complex pre-fabricated deck so as to achieve a layout and appearance comparable to that of a conventional boat built of aluminum or FRP;
3) When vent holes and loading ports in the mold must be placed in areas that cannot be hidden from sight and must be flush with the surrounding plastic, how to cover up said vent holes and loading ports in a clean and efficient manner without relying on industry standard spinweld plugs that can collect water, that can potentially have a relatively crude look and finish, and pose a risk of improper installation, and;
4) When various male cavities must be molded into flat, horizontal surfaces, such as for drain channels or stiffening ribs, and these cavities cannot be hidden behind deck panels or other outfitting structures, how to cover up said male cavities so as to maintain the flush continuity of the surrounding plastic surface while maintaining a clean appearance on par with that of a conventional boat built of aluminum or FRP. Tangentially to this problem, when low modulus deck coverings—such as blended foam sheet materials—are to be installed on flat, horizontal surfaces, and said flat horizontal surfaces are broken up by such male cavities as described above, how to provide support for these low modulus deck coverings so as to prevent them from sagging down into the male cavities.

Problem #1: Running Hoses & Cables

In conventional aluminum and FRP boat construction, electrical cables, hoses, and conduits can be installed between the hull and deck with relative ease and simplicity. This is because both aluminum and FRP boat construction are able to have the hull and deck be structures separate from one another during various stages of construction. This gives builders easy access to the underside of decks and the voids between the hull and decks for running cables, hoses, and conduits. Once the boat is complete, these items are hidden from view and do not interrupt the functional layout of the boat.

In a rotational molded boat, however, there is no such void space beneath the molded plastic body since the molded plastic body is a sealed, hollow shell of plastic. In addition, the interior of the hollow plastic body tends to be required to be filled completely with foam to meet legal requirements, or the geometry of the plastic body is such that running rigging tubes in the interior of the hollow shell is infeasible or excessively complex compared to the ease with which aluminum and FRP boat construction handles the same problem.

Problem #2: Installing Industry Standard Equipment

There are certain pieces of equipment necessary to a boat's outfit that are practically available only through third party manufacturers and that are designed for boats built of aluminum and FRP. These equipment items include, but are not limited to, navigation light fixtures, deck fill caps for fuel tanks, and receptacles for electrical plugs. These industry standard equipment items tend to be exclusively designed for installation through a hole in the aluminum or FRP, where access to the underside of the hole is required due to the items having protruding parts that extend a substantial distance into the void space beneath the aluminum or FRP. Boats built of aluminum or FRP have these void spaces readily available and easy to access.

In a rotational molded boat, however, no such readily accessible void space under the molded plastic shell is available without destructively modifying the molded plastic shell by cutting it open. Because that void may have to be filled completely with an expanding foam, the parts of the equipment items that protrude into the void would have to be protected from the foam via a specially-sized and installed rigging tube, or else the expansion of the foam interferes with the function of the part. Such rigging tubes represent an excessively complex solution for a problem that is solved simply by aluminum and FRP construction.

Problem #3: Vent Holes & Loading Ports.

Most rotational molded parts require holes in the mold to vent overpressure inside the plastic part caused by the expansion of heated air inside the mold and to eliminate negative pressure caused by the contraction of the heated air as it cools. These vent holes tend to not be numerous and are few enough in number that a rotational molded plastic boat can strategically locate them in areas that can be easily covered up and hidden from sight using equipment part of the boat's outfit.

However; a rotational molded boat must also be able to have the void within the molded plastic shell filled with an expanding, closed cell foam. For a rotational molded boat of simple geometry, such as where all of the molded-in structural elements run in the longitudinal direction, foam filling is relatively straightforward and the vent holes can be located in the bilge. But, for a rotational molded boat of complex geometry, where the molded-in structural elements are both longitudinal and transverse, foam needs to be injected into the cavity at numerous, dispersed locations. These locations may not necessarily correspond to the existing vent holes and additional holes for foam filling may need to be provided. In addition, these holes for foam filling have to be located at the tops of the structural elements. For rotational molded boats of complex geometry, these foam-fill holes will often have to be located in areas visible to the customer and so attention must be given to both the function and aesthetic aspects to the way these holes are covered.

The same situation applies to loading ports for adding plastic powder to the closed mold. A rotational molded boat with numerous double-walled features in the longitudinal and transverse directions, and closed off from one another by kiss-offs, will require plastic powder to be portioned out and added to specific areas in the mold after the two halves of the mold are closed. Some of the holes already in place for venting and foam filling can act as these loading ports, so the same need for covering them applies.

In a conventional boat built of aluminum or FRP, foam filling can be performed during various stages of the boat's construction due to having access to the interior of the hull before the deck structure is installed. Spaces that would otherwise be difficult to fill with foam for the completed boat can be filled with foam earlier in construction while those spaces are more accessible.

Problem #4: Male Cavities in Horizontal Surfaces.

One advantage of using rotational molding to create a plastic-hulled power boat is the ability to create both deck structure and deck surface using molded-in horizontal, flat surfaces at the tops of structural elements. The advantages of doing this are: (1), a deck panel for the boat operator to stand on in these areas can be avoided, thereby saving weight and cost, and (2), the need for a substrate to mount a marine flooring material can be avoided depending on the type of flooring material used.

The downside to doing this is that large, flat surfaces in rotational molded parts have a high likelihood of warping, resulting in both an uneven surface and a potentially spongey-feeling deck. In order to prevent this warping and sponginess, stiffening ribs must be molded into these horizontal surfaces, but these stiffening ribs must be male, that is, they "dip down" into the plastic, in order to avoid protruding above the plane of the surrounding deck surface. As a result, these ribs create open depressions in the deck surface. If a flooring material is to be laid atop a molded-in horizontal, flat surface, then a means of providing support for said flooring material must be provided, but the means of support must also be flush with the surrounding plastic. If no such support is provided, the flooring material will sag into the depressions and create potential tripping hazards in addition to a poor fit and finish. If a means of support is provided but is not flush with the surrounding plastic, then the installation of the flooring material could be impaired, along with causing dips and humps in the flooring, reducing the appearance and quality of the plastic boat compared to a conventional boat without these problems. Alternatively, if no flooring material is used, then a means of covering up the stiffening rib must still be provided and this means of covering must still achieve a clean fit and finish.

The Problems in Context

These aforementioned problems must be viewed in terms of the reasons for using rotational molding as an advantageous alternative to aluminum and FRP construction. The primary advantage of using rotational molding for the construction of power boat hulls is the drastic reduction in labor required to create hydrodynamic hulls with compound curvature. These hull characteristics are otherwise only achieved with FRP, while aluminum boat construction is practically restricted to flat panels and significantly simpler curvature.

In rotational molding, when the sealed mold is filled with powdered plastic and placed in the oven, the oven does the work of molding the hull, not teams of welders, or fiberglass workers laying mat and rolling resin. An additional advantage of using rotational molding for the construction of power boat hulls is the ability to include numerous molded-in longitudinal and transverse structures that provide both global and local structural reinforcement of the hull and decks, and create numerous compartments for storage, thereby avoiding the need for elaborate pre-fabricated decks that FRP and aluminum must use.

If rotational molded power boats are to compete in quality and performance against conventional boats made of aluminum or FRP, they must be able to run cables, hoses, and conduits in such a way as to achieve the layout and finish of a conventional boat; they must be able to install industry standard outfitting equipment and still achieve the fit and finish of a conventional boat; they must be able to cover up necessary holes in the plastic and still achieve the fit and finish of a conventional boat, and; they must be able to cover up cavities in horizontal decks and still achieve the fit and finish of a conventional boat. In addition, if rotational molded power boats are to compete in price against conventional boats constructed of aluminum or FRP, they must be able to solve these problems without resorting to excessively complex or costly solutions, keeping in mind that conventional boats built of aluminum or FRP do not have these challenges.

Recognizing that the key economic advantage of rotational molding over aluminum or FRP construction is the ability to mold the hull and deck-supporting structure as one integral piece of plastic, the present invention provides a common solution for the numerous problems described above. The solution involves strategically locating and designing various molded-in cavities in the plastic that are designed to accept post-molded cover plates that get secured to the plastic in a flush and/or nonobstructive manner to surrounding boat structures, thereby achieving both a simple and clean-looking finish.

SUMMARY OF THE INVENTION

The present invention relates to a generic power boat hull that is rotationally molded out of plastic, utilizing a combination of numerous male cavities, kiss-offs and other molded-in features integral with the hull to create an interior layout and appearance that is comparable to a conventional boat built of aluminum or FRP. The extensive use of the aforementioned molded-in features avoids the need for elaborate pre-fabricated decks, and avoids the need to cut into the molded plastic shell to install hoses, cables, and other outfitting items, thereby preserving the labor savings inherent to using rotational molding to create a boat hull versus aluminum or FRP construction. This includes the application of numerous molded-in trench-like male cavities strategically located throughout the boat. These trenches are comprised of a "primary" cavity section forming the bottom of the trench and a "secondary" cavity section forming the top of the trench. The primary cavity section accomplishes the functional aspect of the invention, whereas the secondary cavity section accomplishes both the aesthetic and finishing aspect, and provides a mounting surface for the cover plate. The primary cavity section is of a depth and width determined by the purpose of the trench. The secondary cavity section is of a depth and width that allows a cover plate to be installed into the secondary cavity so that the cover plate is either flush with the surrounding plastic or does no obstruct surrounding boat structures.

In the present invention, male cavities are molded into the plastic hull for a variety of purposes, and more specifically to facilitate the installation of electrical cables, hoses, and conduits; the installation of industry standard outfitting items; the covering of holes in the plastic in areas visible to the boat's operator; and the covering of stiffening ribs and drain channels in horizontal deck surfaces. In addition, these molded-in male cavities are specifically designed to enable the flush fitting of a cover plate over their top, accomplishing several tasks in the process:

1) Since the plates are flush with the surrounding plastic, the goal of achieving a conventional fit and finish is achieved;
2) Since this "trench-and-plate" solution can be applied generally, versus relying on conveniently located outfitting equipment to act as cover plates, a conventional boat layout can be achieved;
3) The plates in conjunction with the secondary cavities of the trenches act as tie-downs to hold hoses and cables in place, where the stiffness of the hoses and cables would otherwise force them out of the primary cavities;
4) The plates in conjunction with the secondary cavities act as simple to install and aesthetically pleasing means of installing industry standard outfitting items that otherwise are not designed for rotational molded boat hulls;
5) The plates in conjunction with the secondary cavities act as simple to install and aesthetically pleasing means of providing support for low modulus floor coverings over the tops of the trenches in flat, horizontal surfaces;
6) The plates in conjunction with the secondary cavities act as simple to install and aesthetically pleasing means of covering up molded-in structures that are inherent to rotational molded boats, but would otherwise look out of place when compared to a conventional boat build of aluminum or FRP.

Further areas of applicability of the present invention will become apparent from the detailed description provided hereinafter.

BRIEF DESCRIPTION OF THE DRAWINGS

The present invention will become more readily understood from the detailed description in conjunction with the accompanying drawings, wherein like reference numerals designate like structural elements, and wherein.

DETAILED DESCRIPTION

Reference will now be made in detail to representative embodiments of the present invention as illustrated in the accompanying drawings. The following descriptions are not intended to be understood in a limiting sense, but to be an example of the invention presented solely for illustration thereof, and by reference to which in connection with the following description and the accompanying drawings one skilled in the art may be advised of the advantages and construction of the invention.

Figure 1:
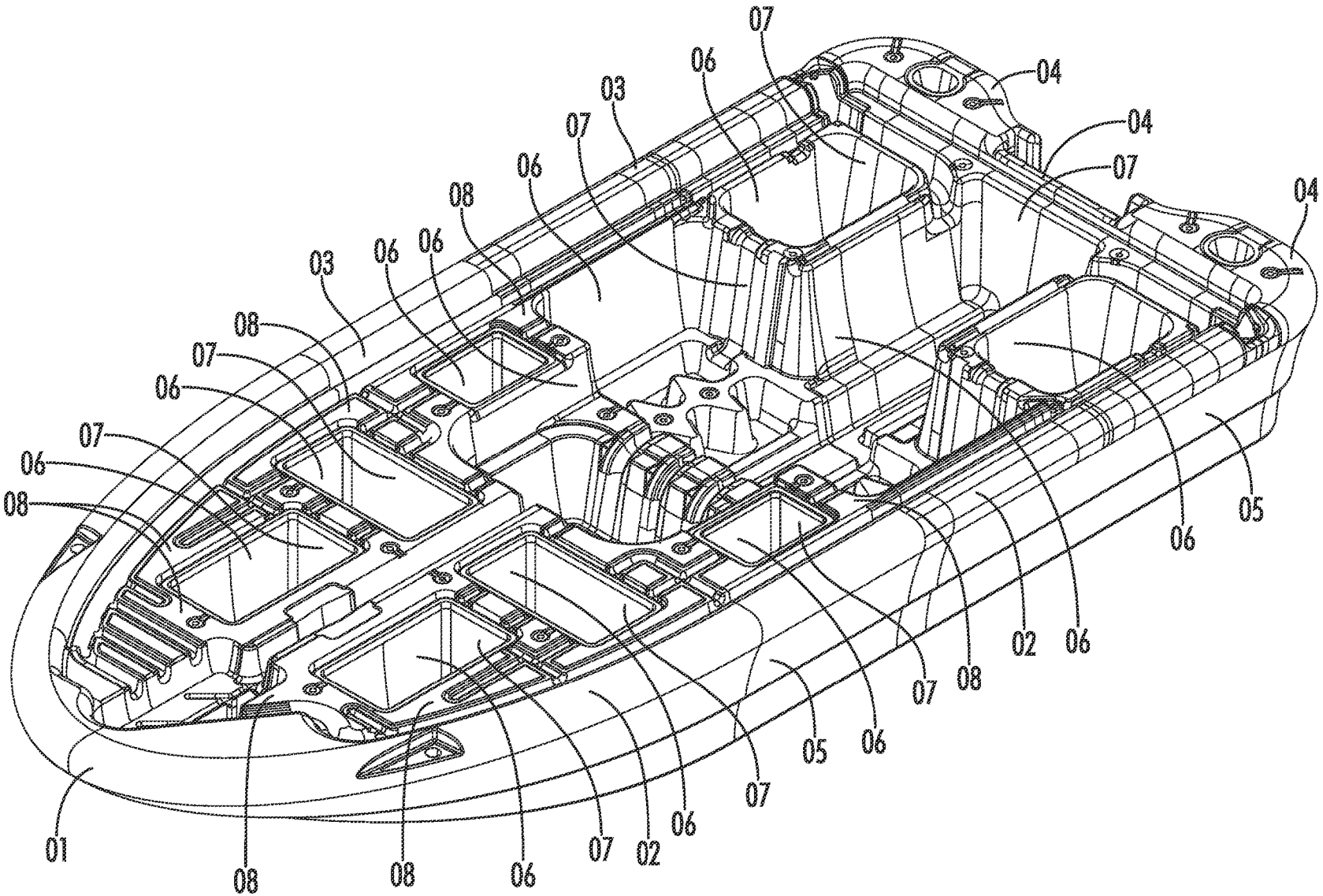
FIG. 1 is a perspective view of a generic rotational molded fishing boat containing the molded-in features and male cavities (trenches) of the present invention. Only the molded plastic is shown.

With further reference to the drawings, a generic rotational molded fishing boat is depicted in FIG. 1. The rotational molded fishing boat utilizes numerous male cavities, kiss-offs, and various molded-in features to achieve an internal layout of close similarity to that of boats built of aluminum or FRP. The rotational molded boat seen in FIG. 1 can be manufactured from various materials suitable for the rotational molding process, but would typically be made of polyethylene plastic.

As is illustrated in FIG. 1, the rotational molded boat includes an outer hull indicated generally by the numeral 05, with the bow portion of the hull indicated by numeral 01, the port gunwale indicated by numeral 02, and the starboard gunwale indicated by numeral 03. The transom region of the boat is indicated generally by numeral 04. Molded-in longitudinal vertical walls are indicated generally by numeral 06 and molded-in transverse vertical walls are indicated generally by numeral 07. These vertical walls define the boundaries of the various molded-in male cavities. Molded-in horizontal flat surfaces positioned around the various molded-in male cavities are indicated generally by numeral 08 and provide both structural support and mounting surfaces for deck panels and marine flooring materials.

Figure 2:
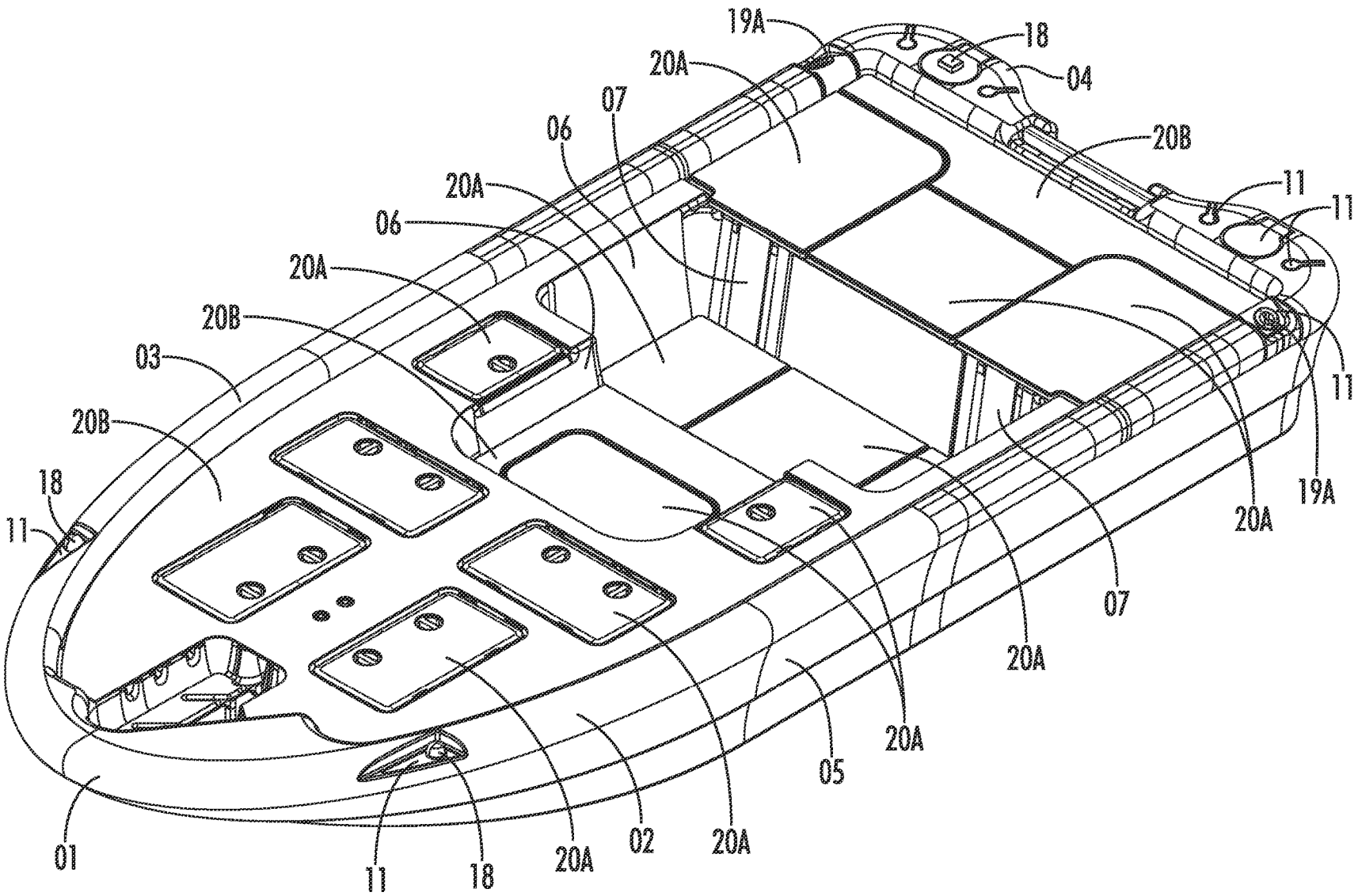
FIG. 2 is a perspective view of the same boat from FIG. 1, this time showing the deck panels, compartment hatches, cover plates, marine flooring, and outfitting equipment relevant to the present invention.

In FIG. 2, another perspective view of the boat depicted in FIG. 1 is shown, this time showing a finished boat having cover plates, hatches, and outfitting equipment installed. Cover plates in the present invention are indicated by numeral 11. FIG. 2 provides a depiction of how the present invention achieves the appearance and layout of a conventional boat by hiding the majority of cover plates 11 under marine flooring. In the instances where the cover plates 11 cannot be hidden by marine flooring, such as when used to accommodate navigation light fixtures or fuel fills, the cover plates 11 are discreetly incorporated into the molded plastic hull without interrupting the interior layout or surrounding structures of the boat. Deck hatches with marine flooring installed on top are indicated generally by numeral 20A, whereas areas of fixed deck with marine flooring are indicated generally by numeral 20B. Outfitting equipment in the form of navigation light fixtures are indicated by numeral 18, and outfitting equipment in the form of fuel fill caps or electrical plug receptacles are indicated by numeral 19A.

Figure 3:
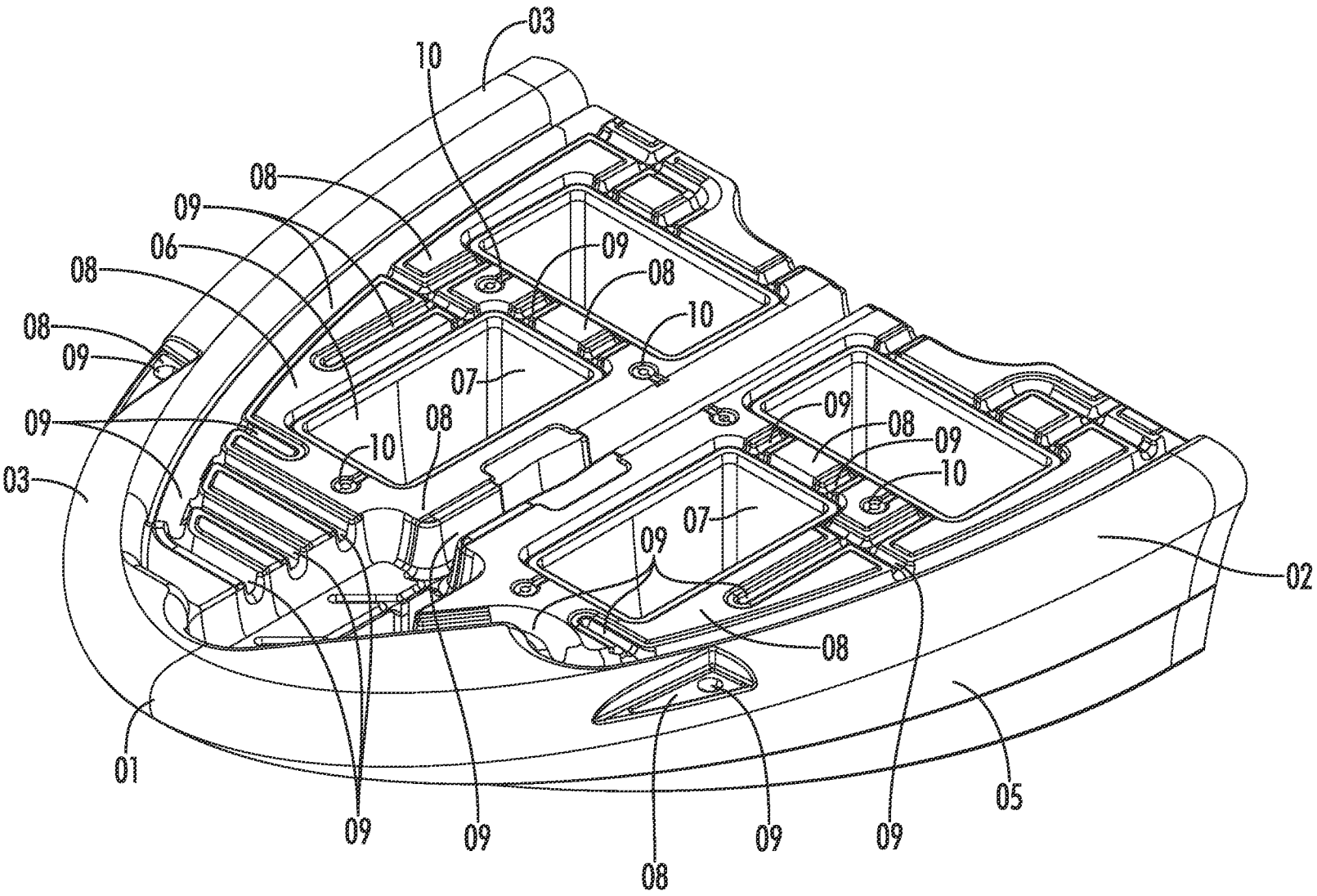
FIG. 3 is a close-up perspective view of the bow section of the boat in FIG. 1, showing only the molded plastic.

In FIG. 3, a close-up perspective view of the bow portion 01 is presented, with only the molded plastic shown. Trenches of the present invention are indicated generally by numeral 09. These trenches 09 are male cavities molded into the horizontal surfaces 08. In this close-up view, the versatility of the trenches 09 from the present invention is apparent. The purpose of the molded-in trenches 09 is to facilitate the installation of electrical cables, hoses, conduits, and industry standard outfitting items, to cover any holes in the plastic in areas visible to the boat's operator, and to cover stiffening ribs and drain channels in horizontal deck surfaces. The trenches are able to vary in shape so as to "snake" around surrounding molded-in features that exist to achieve a conventional boat layout. In addition, vent holes in the plastic with their associated secondary cavities of the present invention are indicated generally by numeral 10. The purpose of the vent holes 10 is threefold: (1) to provide adequate venting during the rotational molding process, (2) to act as loading ports for adding powdered plastic to the closed mold, and (3) to allow the interior of the molded hull to be completely filled with expanding foam to meet regulatory requirements.

Figure 4:
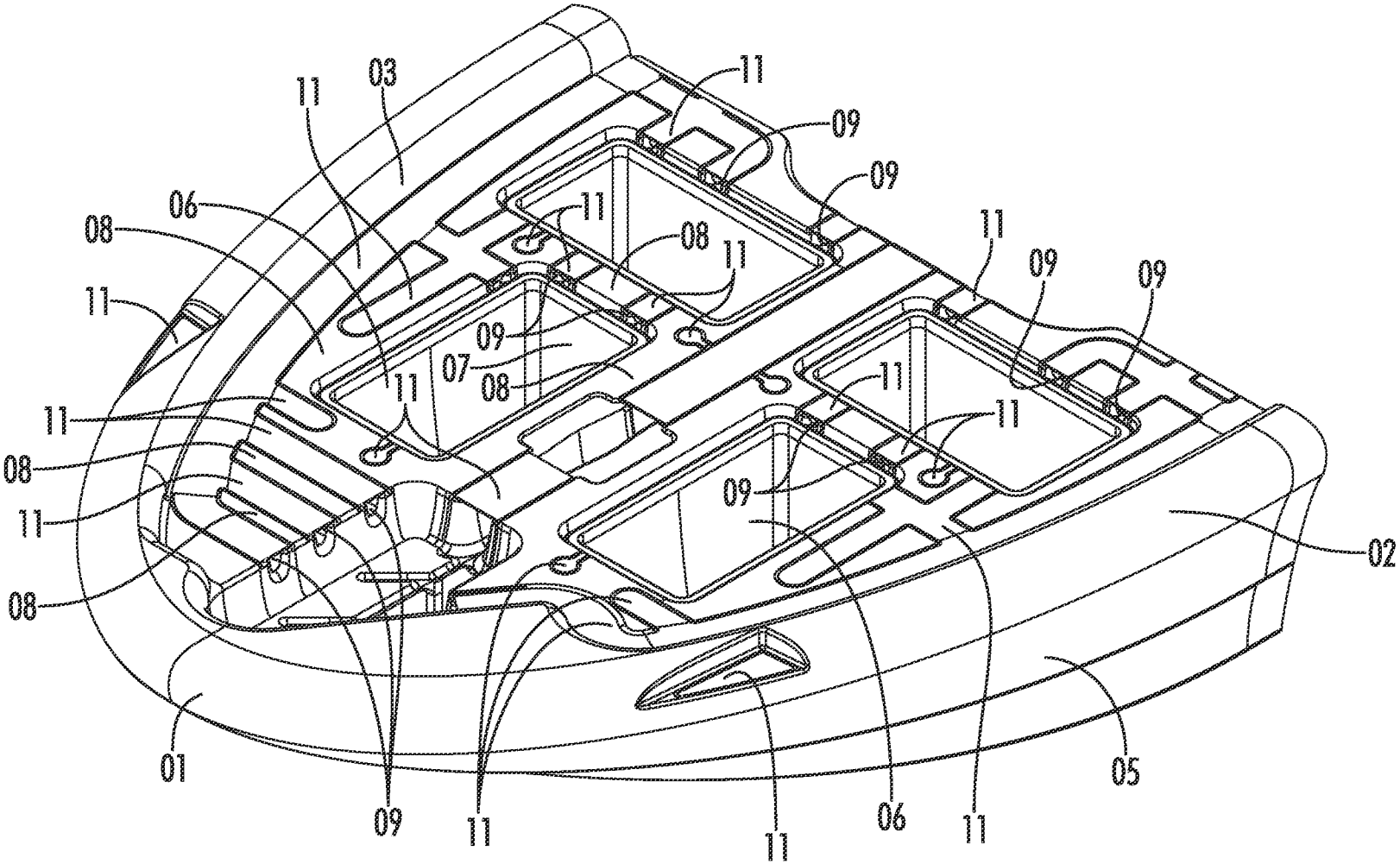
FIG. 4 is the same view as from FIG. 3, but this time showing the cover plates of the present invention installed over the molded-in trenches.

FIG. 4 is the same view as FIG. 3, but with the cover plates 11 shown secured over the trenches 09. The trenches 09 are designed to accept cover plates 11 in a flush manner, thereby achieving both a simple and clean-looking finish. The manner in which the cover plates 11 of the present invention conform to the variable shapes of the trenches 09 is apparent in FIG. 4, along with how the cover plates 11 achieve continuity with the surrounding plastic molded-in horizontal surfaces 08.

Figure 5:
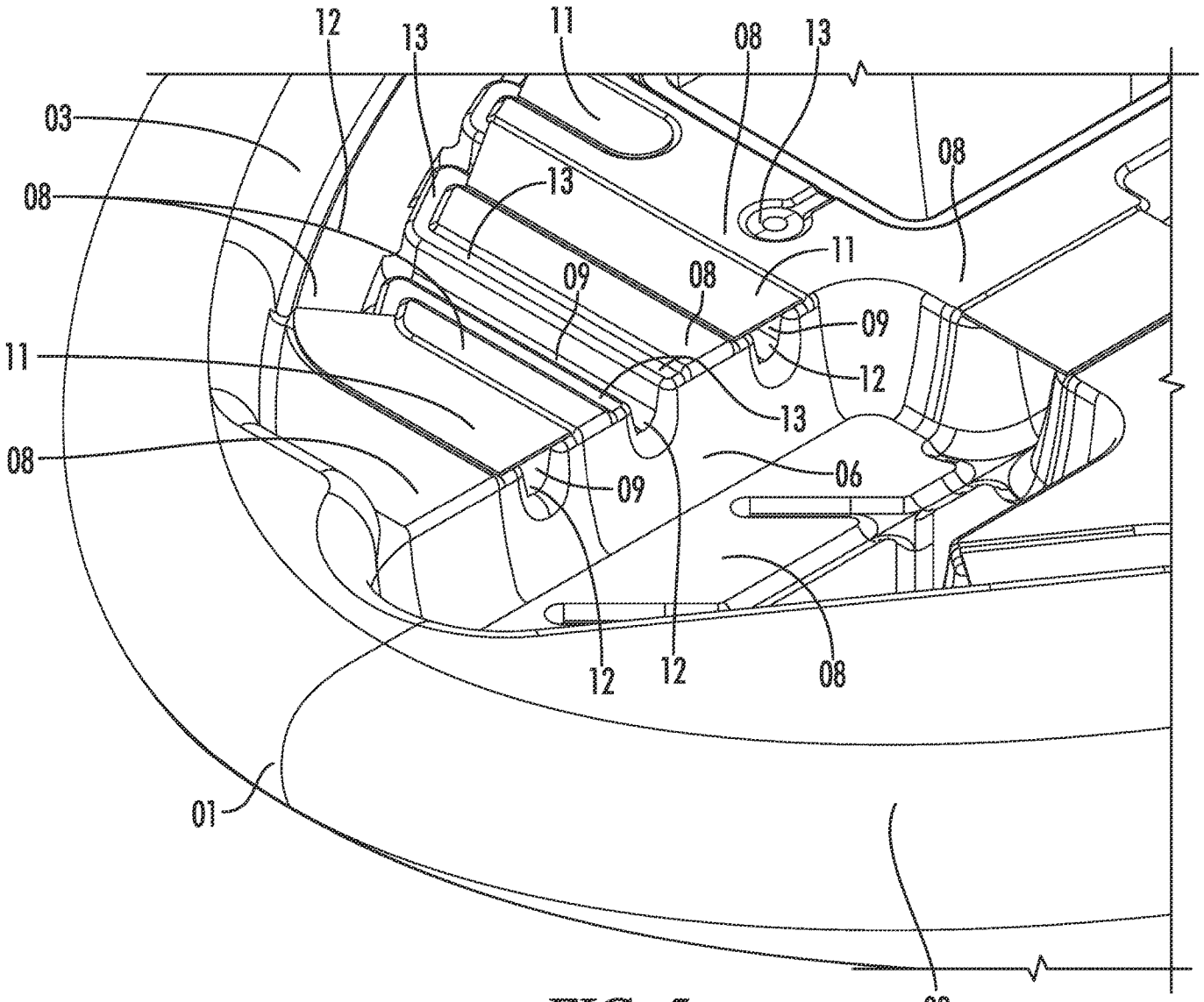
FIG. 5 is a close-up view of several generic stiffening ribs and their associated cover plates, which are exemplary of the overall concept as it pertains to stiffening ribs in horizontal, flat surfaces in the present invention. Several cover plates have been removed to show in better detail the structure of the trenches that are hidden by the plates.

FIG. 5 is a close-up perspective view of several molded-in trenches 09 of the present invention in the forward deck or bow portion 01. The trenches 09 include a primary cavity indicated generally by numeral 12 and a secondary cavity indicated generally by numeral 13. Cover plates 11 are also shown secured over some of the trenches 09.

Figure 6:
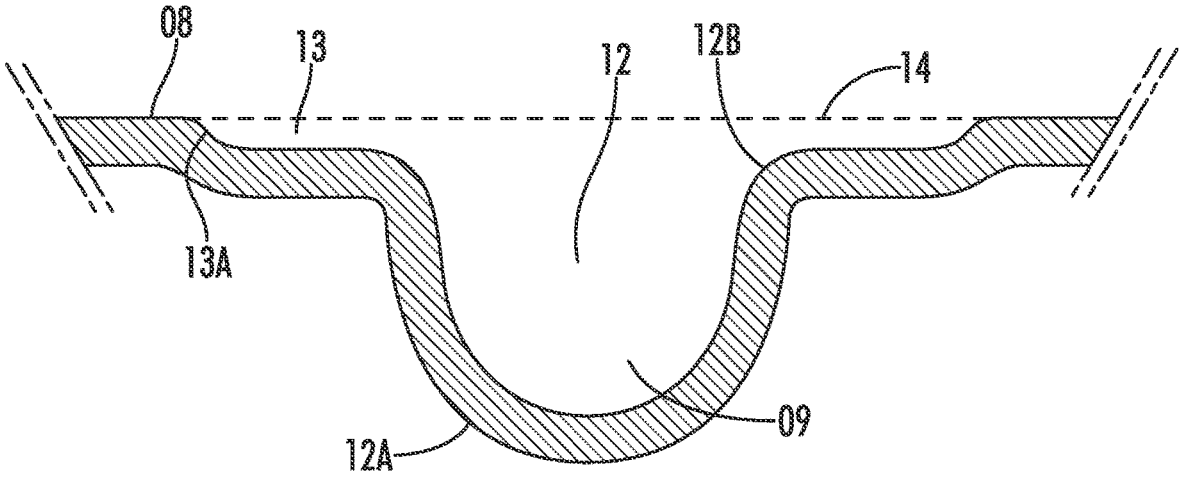
FIG. 6 is a cross-section view showing a generic trench which is representative of trenches acting as stiffening ribs, drain channels, and cable/hose chases in the present invention. Only the molded plastic is shown.

FIG. 6 provides a detailed cross-section view of a generic trench-and-plate solution in accordance with the present invention. The trench 09 is formed of a molded plastic shell. The portion of the molded plastic shell forming the primary cavity 12 is indicated generally by numeral 12A. The edge where the primary cavity 12 blends into the secondary cavity 13 is indicated by numeral 12B, and the edge where the secondary cavity 13 blends into the surrounding horizontal, flat surface 08 is indicated by numeral 13A. The primary cavity 12 has a greater depth than the secondary cavity 13, which is positioned above the primary cavity 12. In addition, the secondary cavity 13 is wider than and spans across the primary cavity 12. The dashed line indicated by numeral 14 represents the plane of the surrounding horizontal molded plastic surface that the trench 09 is recessed or depresses into and also identifies the height of the secondary cavity 13. This dotted line 14 also represents the lost deck surface that the cover plate 11 for trench 09 must replace.

Figure 7:
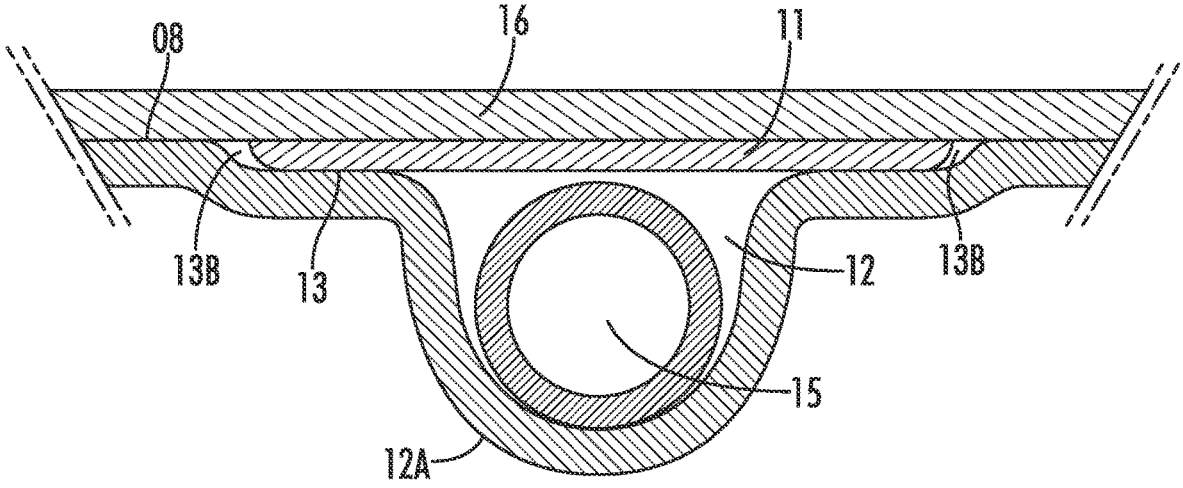
FIG. 7 is the same cross-section view as in FIG. 6, but this time showing a notional cable/hose placed in the primary cavity, along with showing the cover plate of the present invention and the flooring material installed.

FIG. 7 is the same cross-section view as in FIG. 6, but with the cover plate 11 and flooring materials shown, along with a notional cable, hose, or conduit inside the trench. The notional cable, hose, or conduit is indicated by the numeral 15 and can either be installed loosely in the primary cavity 12 or can be bonded to the primary cavity 12 either via fasteners, glue, or any combination thereof. The cover plate 11 has a width that is greater than the width of the primary cavity 12 and is shaped complementary to the secondary cavity 13 such that it sits on the horizontal surface of and substantially fills the secondary cavity 13 and is bonded to the second cavity 13 either via fasteners, glue, or any combination thereof or other suitable means. The flooring material is indicated generally by numeral 16 and is bonded to both the cover plate 11 and surrounding plastic horizontal surface 08. The gap region between the cover plate 11 and the surface 08, indicated generally by numeral 13B, is typically small enough for deflection of the flooring material to be insignificant, but if it is necessary to reduce the size of gap 13B, the edges of the cover plate 11 can be chamfered or filleted for a closer fit.

Figure 8:
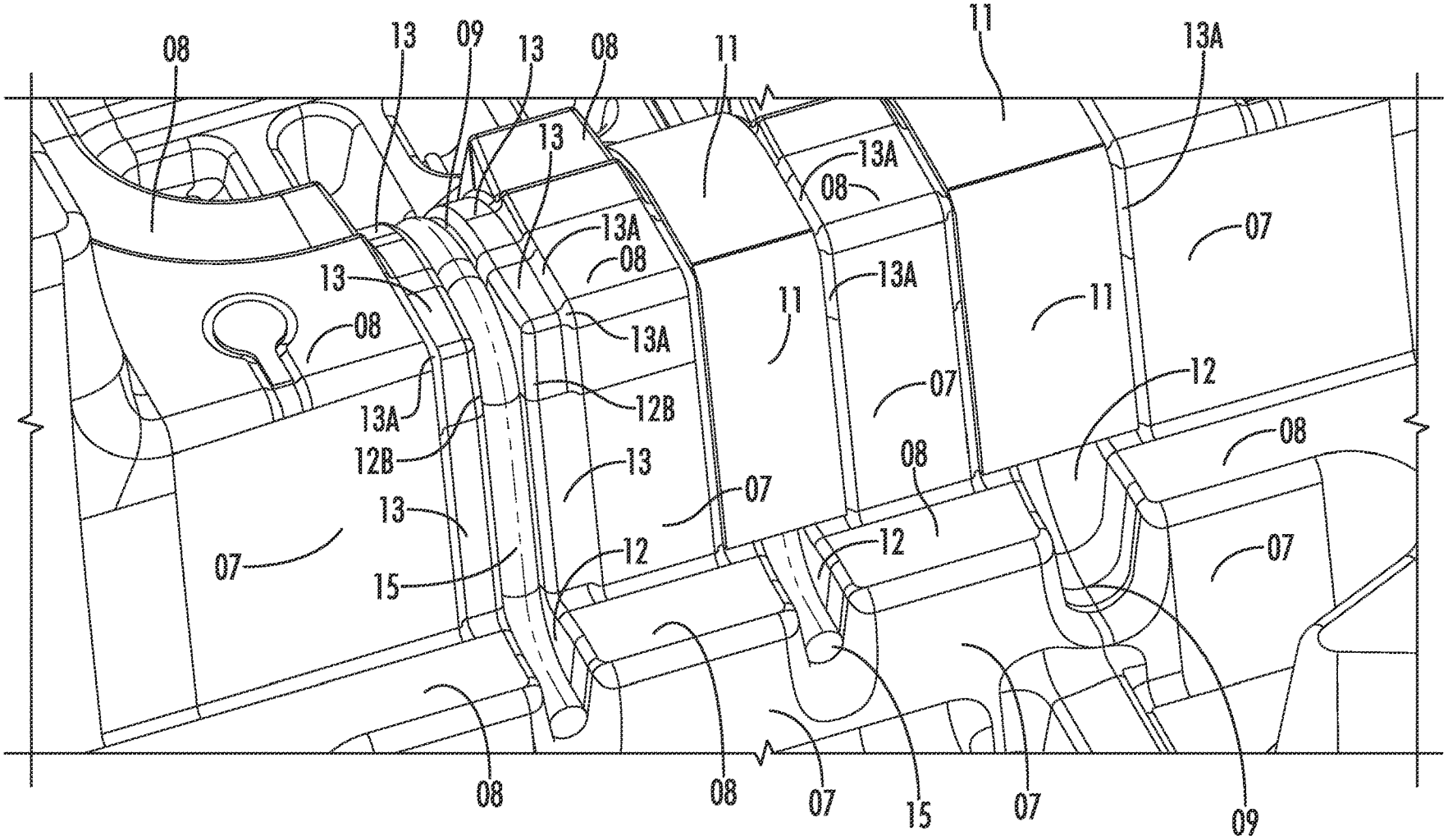
FIG. 8 is a close-up perspective view of a series of trenches dedicated to running and securing hoses for a livewell or any other water-holding compartment to which hoses must be installed, with one trench having the cover plate removed to illustrate the structure of the trenches hidden by the plates.

In FIG. 8, a series of trenches 09 for the purpose of running hoses 15 into a livewell is shown. In this view, the trenches 09 are molded into a transverse structural member 07 that defines one side of a molded-in compartment of the boat. The cover plate 11 for one of the trenches 09 has been removed to better illustrate the relationship between the hose and trench. In this figure, it is apparent how the primary cavity 12 of the trenches 09 of the present invention are able to arc at several locations to accommodate the minimum bend radii of the hoses, or otherwise provide adequate space for the hose and its associated fittings. Additionally, the cover plates 11 also run both vertically and horizontally to cover the entire run of the trench, further illustrating the generic applicability of the present invention.

Figure 9:
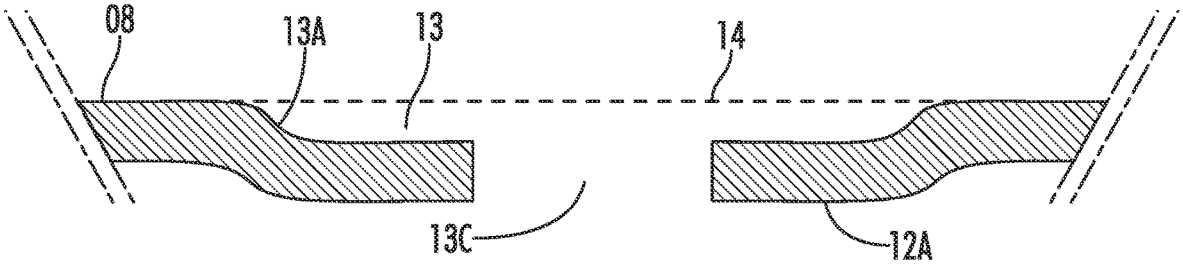
FIG. 9 is a cross-section view of a generic vent hole trench from the present invention, which is representative of other such "vent hole-and-trench" combinations from the present invention.

FIG. 9 is a detailed cross-sectional view of a generic vent hole trench from the present invention. The vent hole in the plastic shell 12A is indicated generally by numeral 13C. This hole can either be molded in place or cut after the boat is molded. Even though the vent hole 13C depicted does not have a primary cavity 12, a secondary cavity 13 is still required to make the cover plate 11 flush with the dotted line 14.

Figure 10:
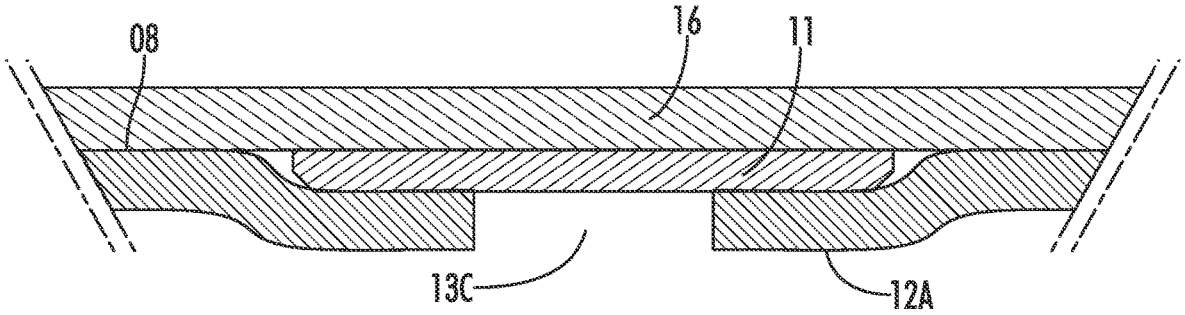
FIG. 10 is the same cross-section view as from FIG. 9, but this time showing the cover plate and flooring material installed.

FIG. 10 is the same cross-section view as FIG. 9, but this time with the cover plate 11 and flooring material 16 shown. The top surface of the cover plate 11 is level with the deck surface 08 forming a solid support structure for installation of the flooring material 16.

Figure 11:
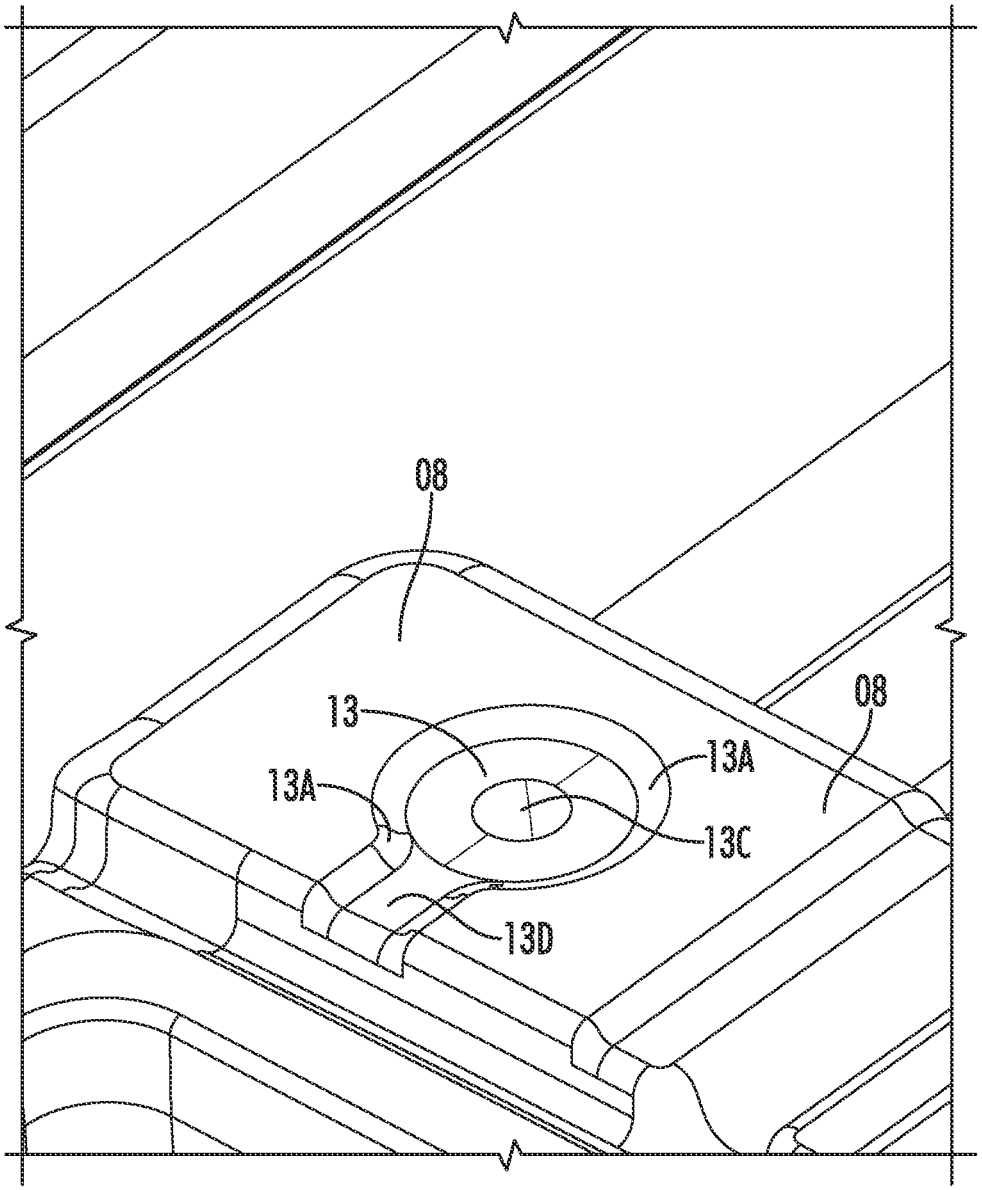
FIG. 11 is a close-up perspective view of a generic vent hole and trench, such as depicted in FIGS. 10 & 11, where a means of draining water from the trench has been provided in the form of a secondary cavity acting as a drain channel.

FIG. 11 shows a perspective view of a vent hole 13C and associated trench secondary cavity 13. In this view, a means of draining water that may collect in the covered trench has been included in the form of an extension of the second cavity 13, represented generally by numeral 13D. The extension 13D extends away from the secondary cavity 13 to a point where the water may drain.

Figure 12:
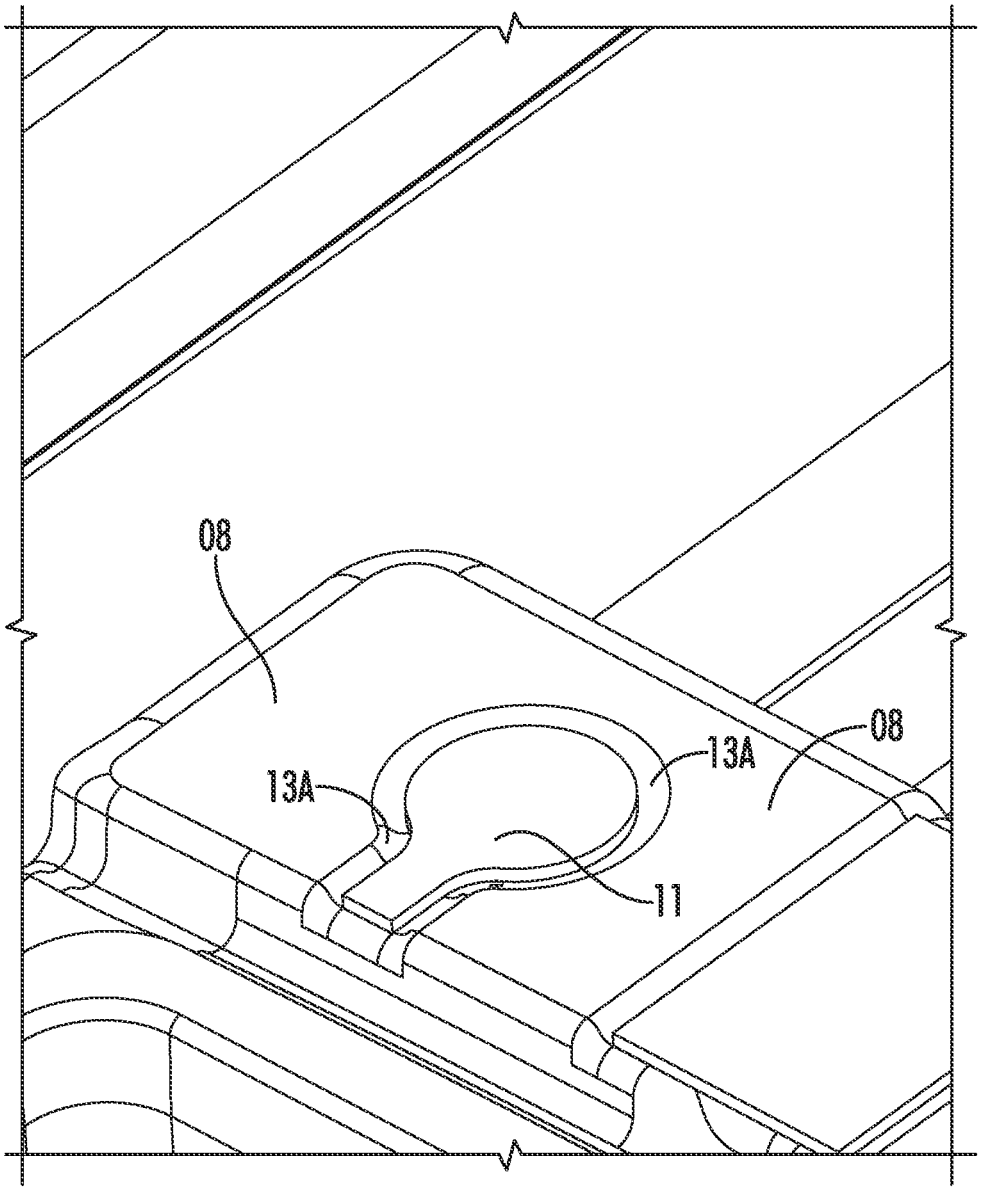
FIG. 12 is the same view as from FIG. 11, but this time with the cover plate shown.

FIG. 12 is the same perspective view as FIG. 11, but this time with the cover plate 11 installed. The unique balloon shape of the cover plate 11 is notional and represents the necessity for covering up the shape of the combined secondary cavity and extended drain trench 13, and demonstrates an advantage of the present invention over conventional spin-weld plugs, which are restricted to circular shapes.

Figure 13A:
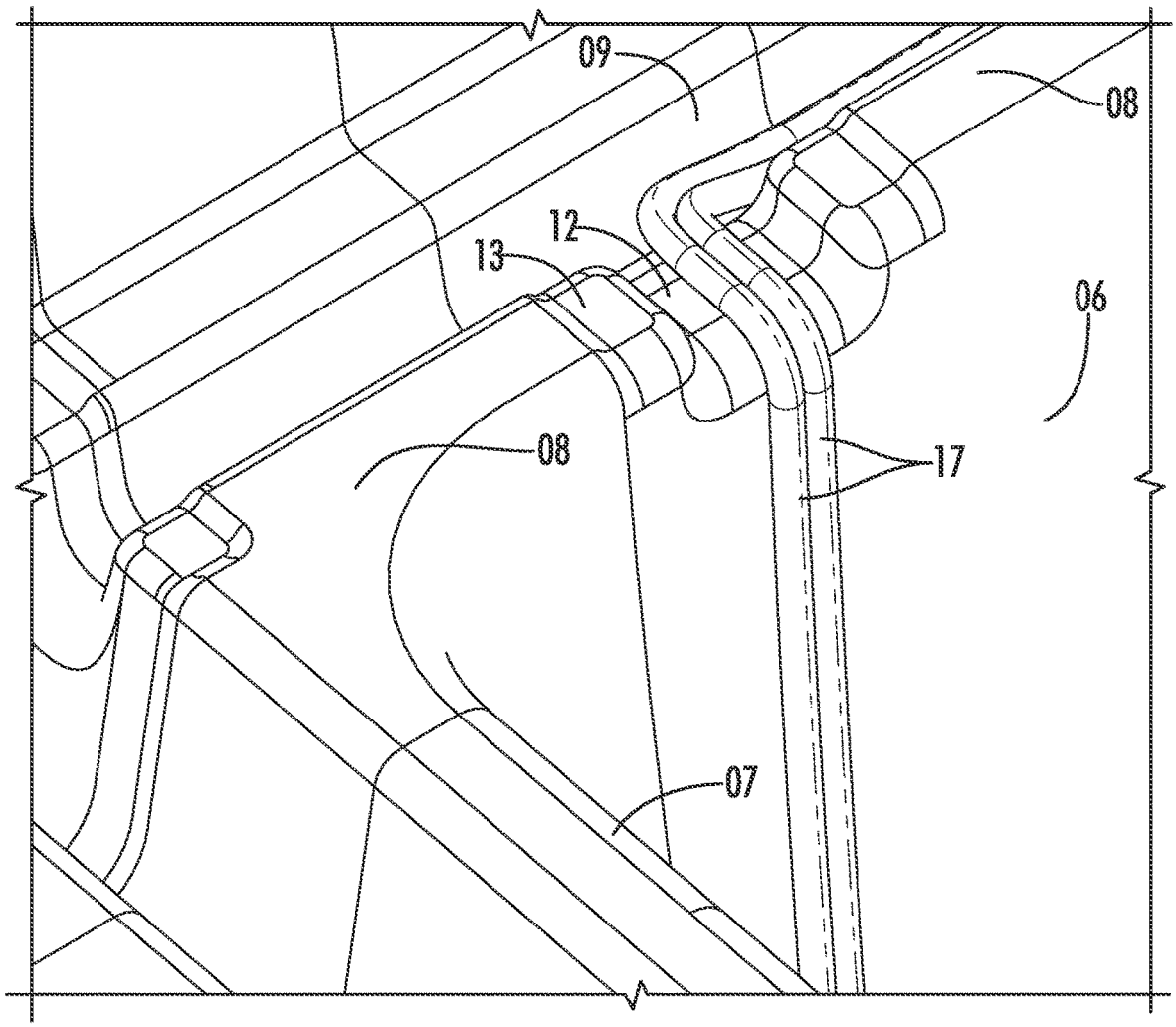
FIG. 13 is a close-up perspective view of a generic trench from the present invention being utilized as part of a chase for electrical cables traveling in and out of a compartment and is representative of other such applications of the present invention as it pertains to running electrical cables. In this view, the cables are entering/exiting a compartment to enter/exit another molded-in cable chase. Only the plastic is shown.

In FIG. 13, a molded-in trench for running electrical cables in and out of a compartment is shown. This trench's primary cavity is indicated generally by numeral 12. The electrical cables are notional and are represented generally by numeral 17. The numerals 06 and 07 represent the longitudinal and transverse vertical walls, respectively, of the compartment's interior. The numeral 08 represents the flat, horizontal tops of the vertical walls 06 and 07. The cable trench is molded into this combination of the longitudinal wall 06 and flat top 08. The electrical cables 17 run through the primary cavity 12 of the cable trench and into or out of the nearby trench 09.

Figure 14:
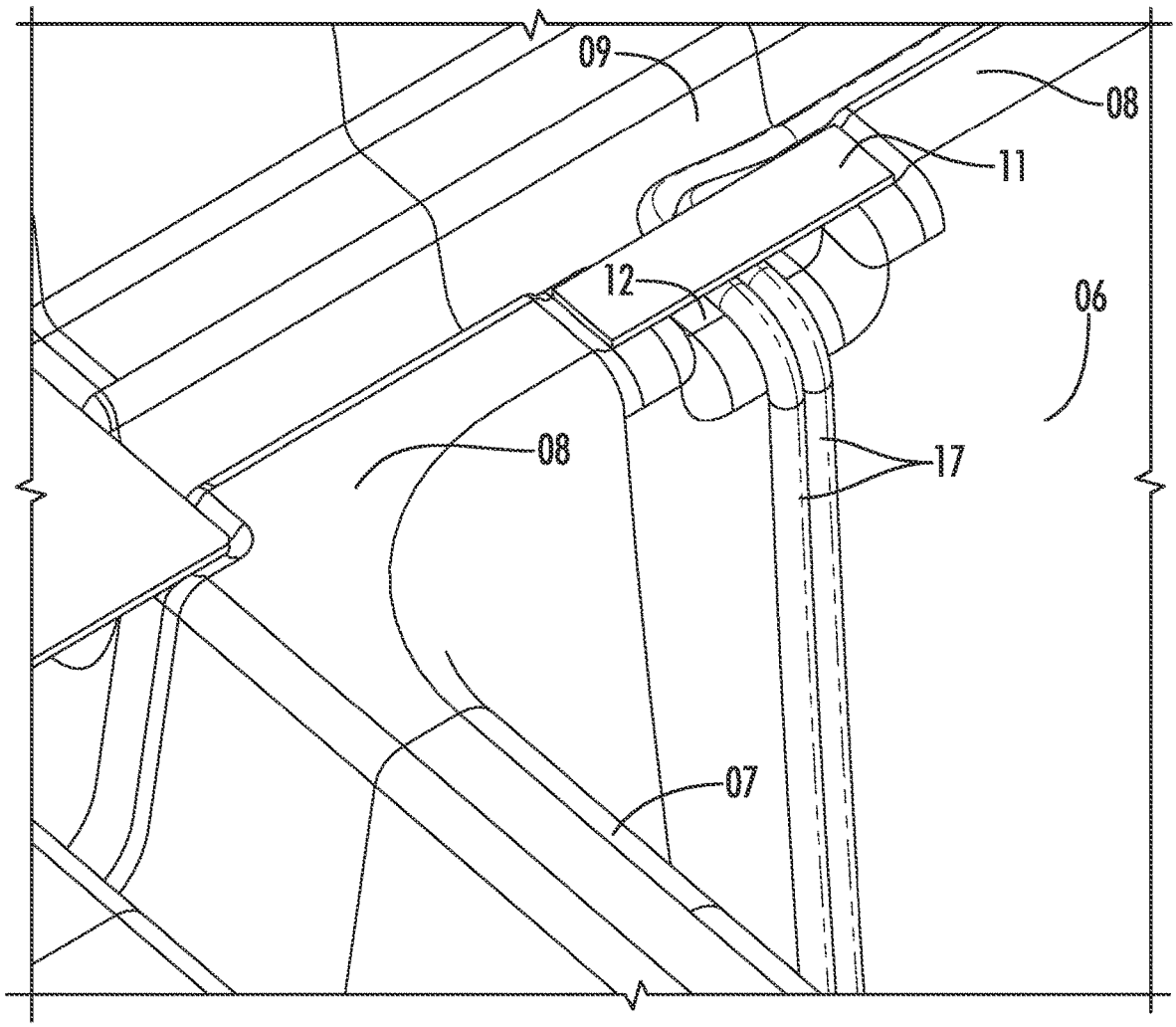
FIG. 14 is the same view from FIG. 13, but this time with the cover plate shown. From this view, it is apparent how the cover plate acts as a tie-down for the cables in the trench and how the secondary trench allows the plate to be flush with the surrounding plastic of the compartment.

FIG. 14 is the same view as FIG. 13, but this time with the cover plate 11 shown secured over the trench 12. In this view, it is apparent how the cover plate 11, when secured in secondary cavity 13, acts as a tiedown for the electrical cables 17 as they run in and out of the compartment in the primary cavity 12. The cover plate 11 also returns continuity to the adjacent horizontal surfaces 08.

Figure 15:
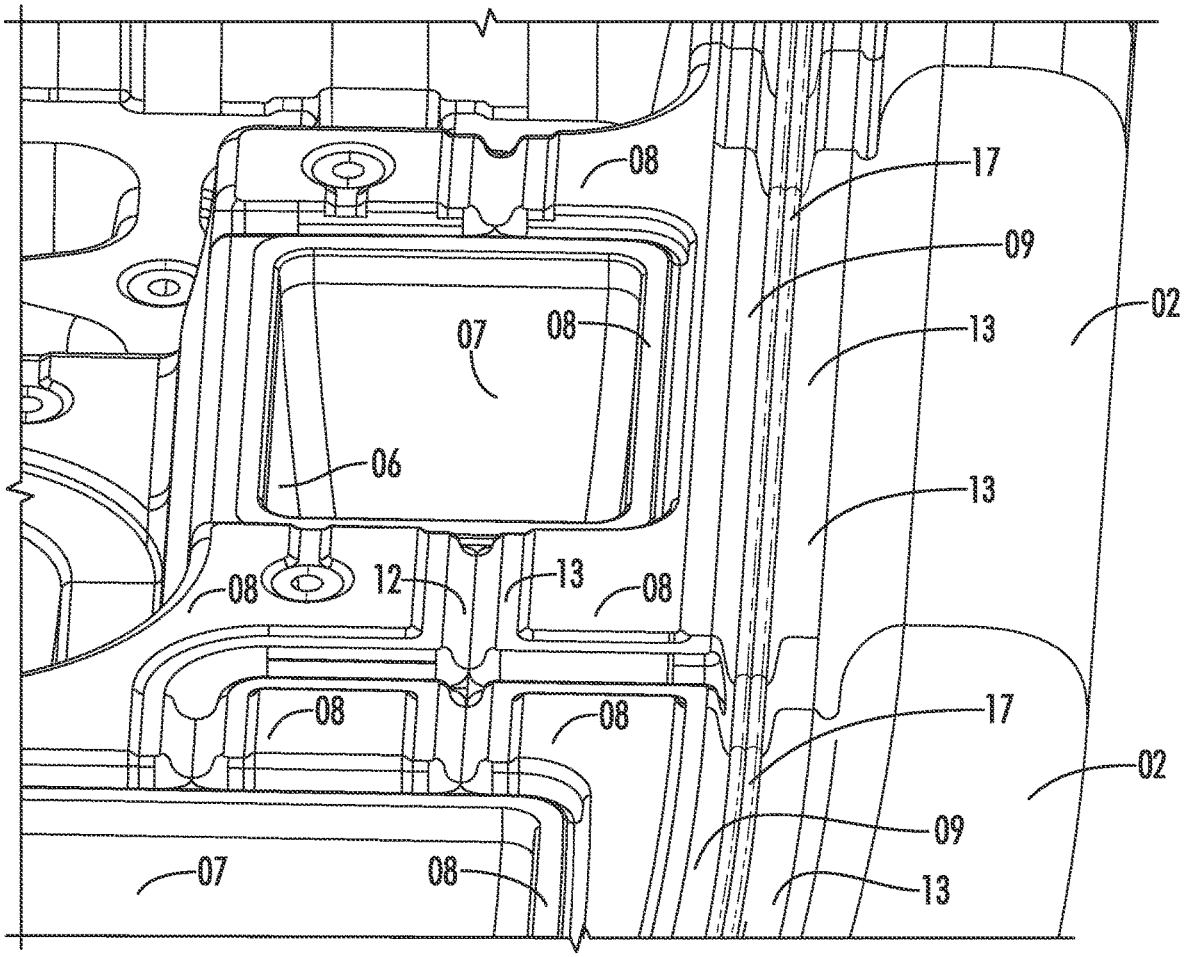
FIG. 15 is another close-up perspective view of a generic trench from the present invention, this time for creating a long, continuous chase for electrical cables. Only the molded plastic is shown.

In FIG. 15, another trench for running electrical cables is shown, but this time as a long, continuous chase between the boat's port gunwale 02 and nearby storage compartments. This trench is indicated generally by numeral 09. In this view, the longitudinal and transverse walls of the compartments are represented generally by numerals 06 and 07, respectively, with the tops of walls 06 and 07 being represented generally by numeral 08. The horizontal flat surfaces 08 represent the mounting surfaces for the hatches of the compartments and are boundaries that the cable chase 09 cannot obstruct. The electrical cables are represented by numeral 17 and sit inside trench 09.

Figure 16:
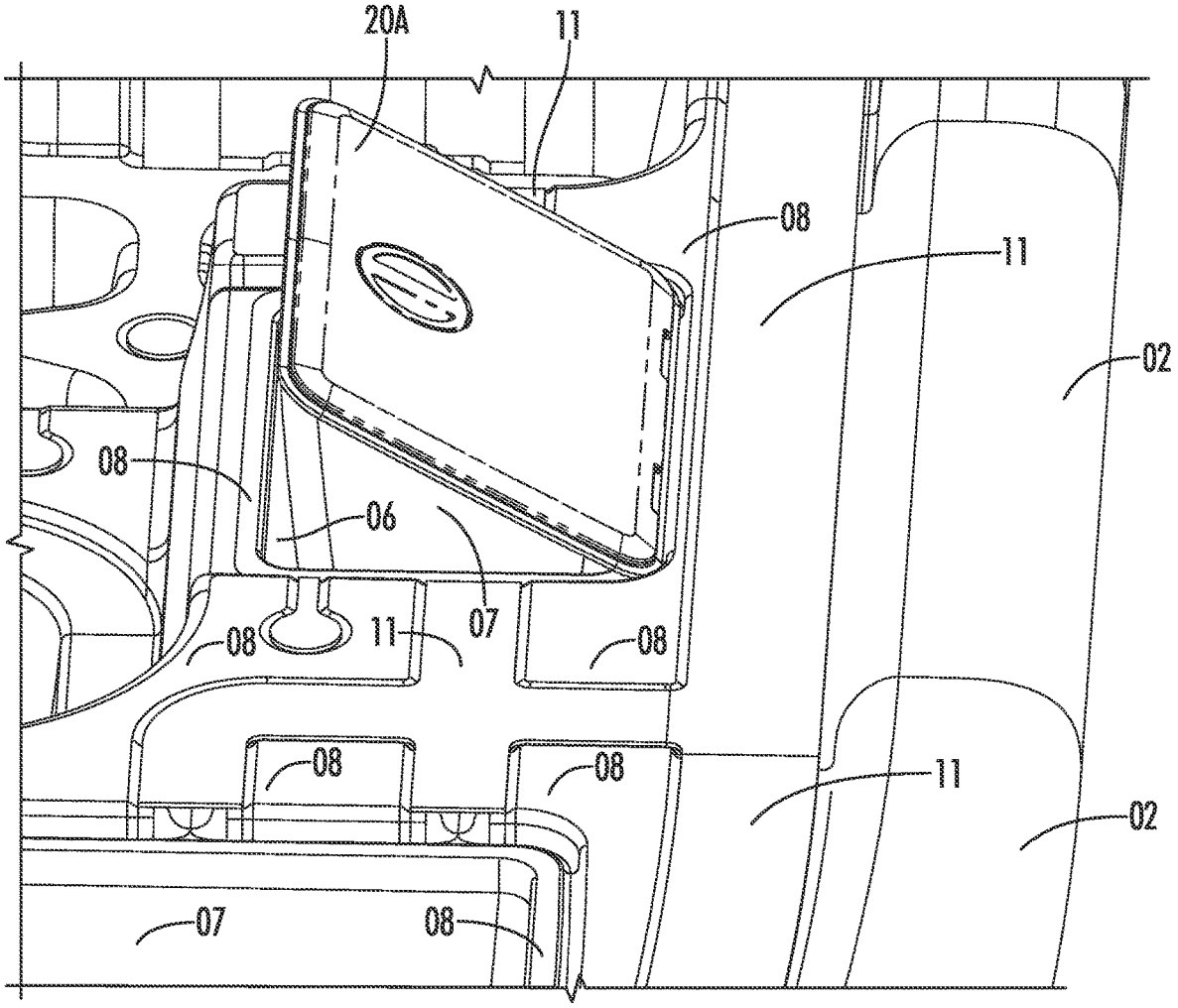
FIG. 16 is the same view as FIG. 15, but this time with the cover plates and nearby compartment hatches shown.

FIG. 16 is the same view as FIG. 15, but this time showing the cover plates 11 and compartment hatches. The compartment hatches are represented generally by numeral 20A and are mechanically connected to the surrounding plastic hull via hinges. In this view, the layout of the cover plates 11, which are supported in secondary cavity 13 of chase 09, is visible along with the gaps between the edges of the plates 11 and surrounding plastic.

Figure 17:
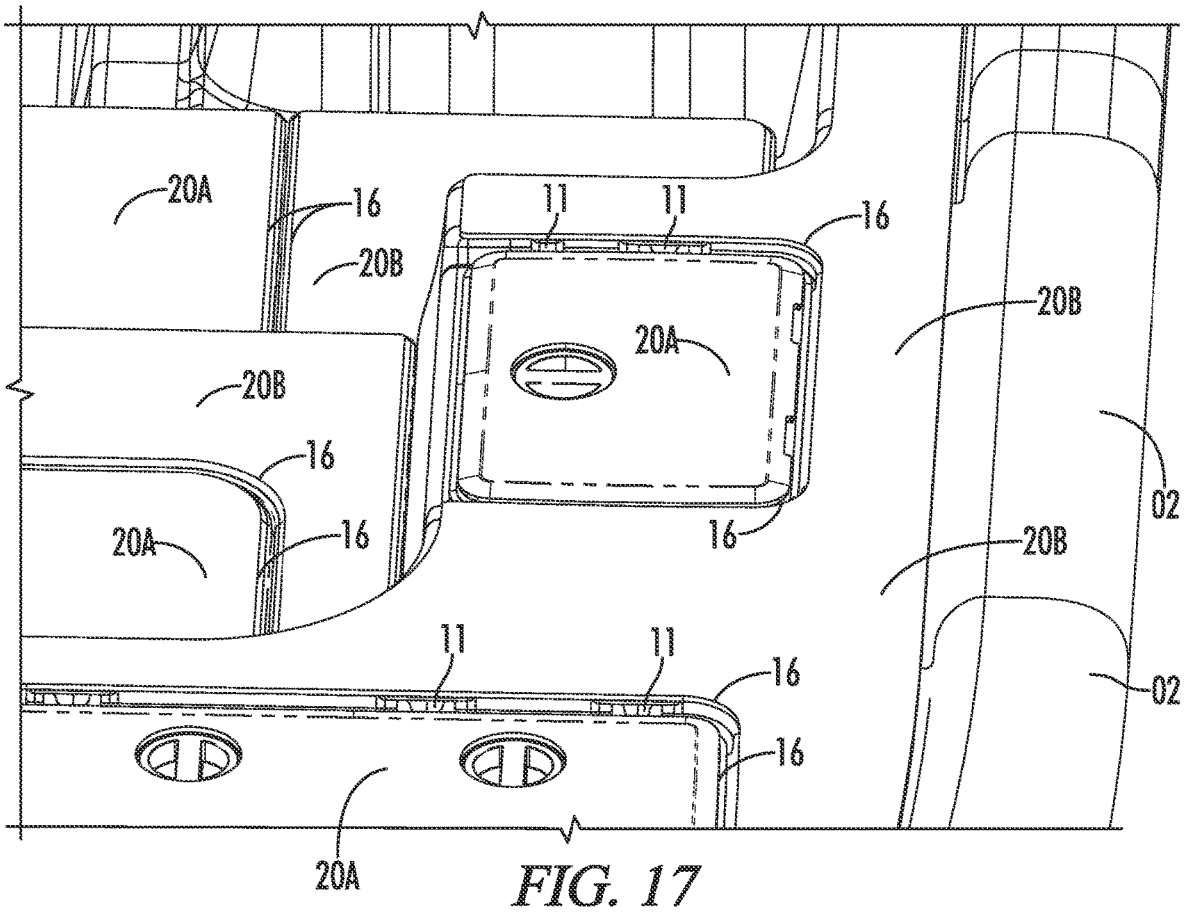
FIG. 17 is the same view of the cable chase from FIGS. 15 & 16, but the flooring material is shown installed on both the trench plates and compartment hatches. This series of FIGS. 15, 16, & 17) help illustrate how the present invention facilitates the layout of a conventional fishing boat without relying on conveniently located outfitting items to cover up necessary cavities in the decks.

FIG. 17 is the same view as FIG. 15, but with the flooring material added. The flooring material, as installed atop of the cover plates 11 and molded plastic, is represented generally by numeral 16. From this view, it is apparent how the unique construction of the present invention, once highly visible in both FIGS. 15 and 16, is successfully hidden by the flooring material 16, resulting in the appearance of a continuous, flat deck. Only at the boundaries of the flooring material 16 is any sign of trench and plate system of the present invention visible, as pointed out by the various numerals 11 in FIG. 17.

Figure 18:
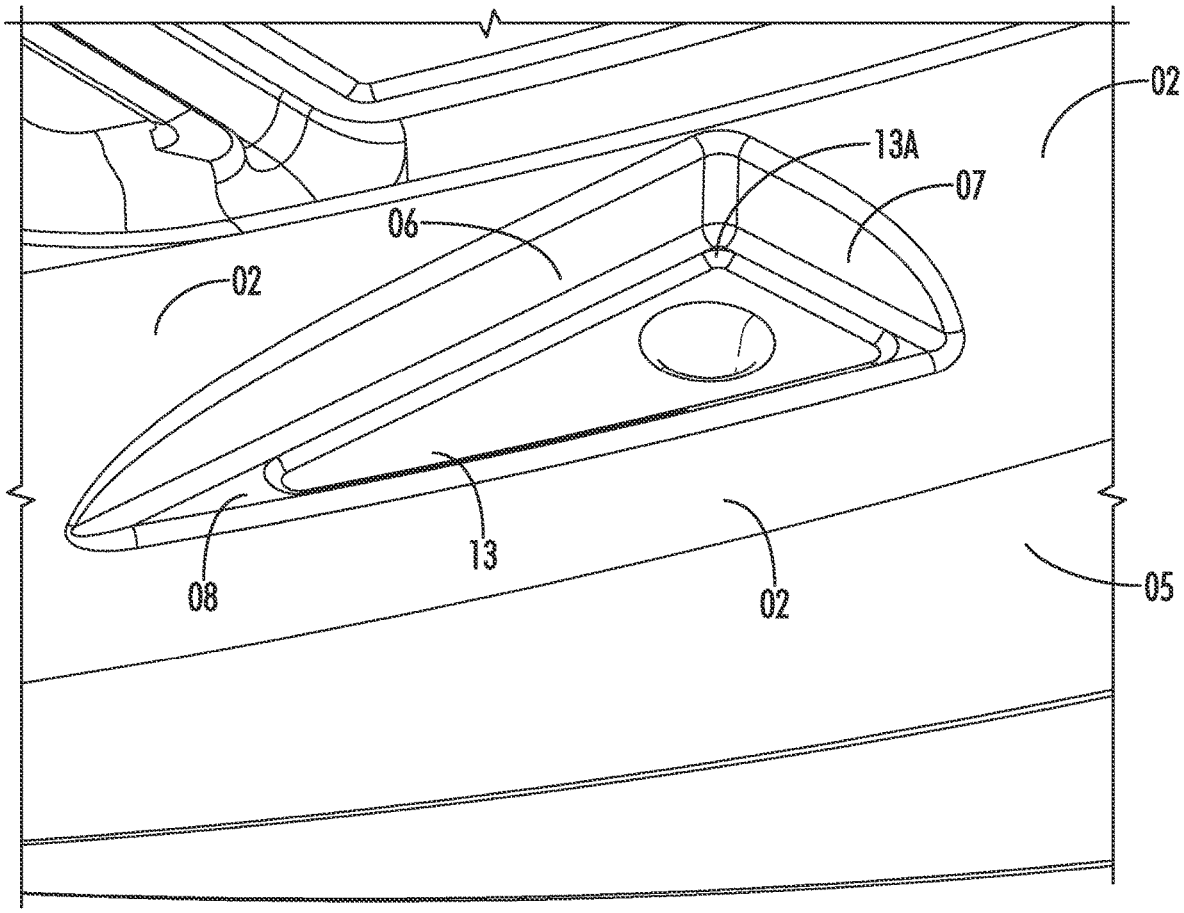
FIG. 18 is a close-up perspective view of the present invention being utilized for the installation of an industry standard piece of outfitting equipment, in this case a navigational light. Only the molded plastic is shown.

In FIG. 18, an application of the present invention installing an industry standard navigation light is shown, with only the plastic visible. Depicted is the port gunwale, indicated generally by numeral 02, with the hull beneath the gunwale indicated generally by numeral 05, as well as longitudinal and transverse vertical walls 06 and 07, and horizontal surface 08. Numeral 12 represents the primary cavity to which the protruding portion of a notional navigation light is installed, with numeral 13 representing the secondary cavity to which the cover plate 11 (see FIG. 19) is installed. The cover place also provides a mounting surface for the navigation light (see FIG. 21).

Figure 19:
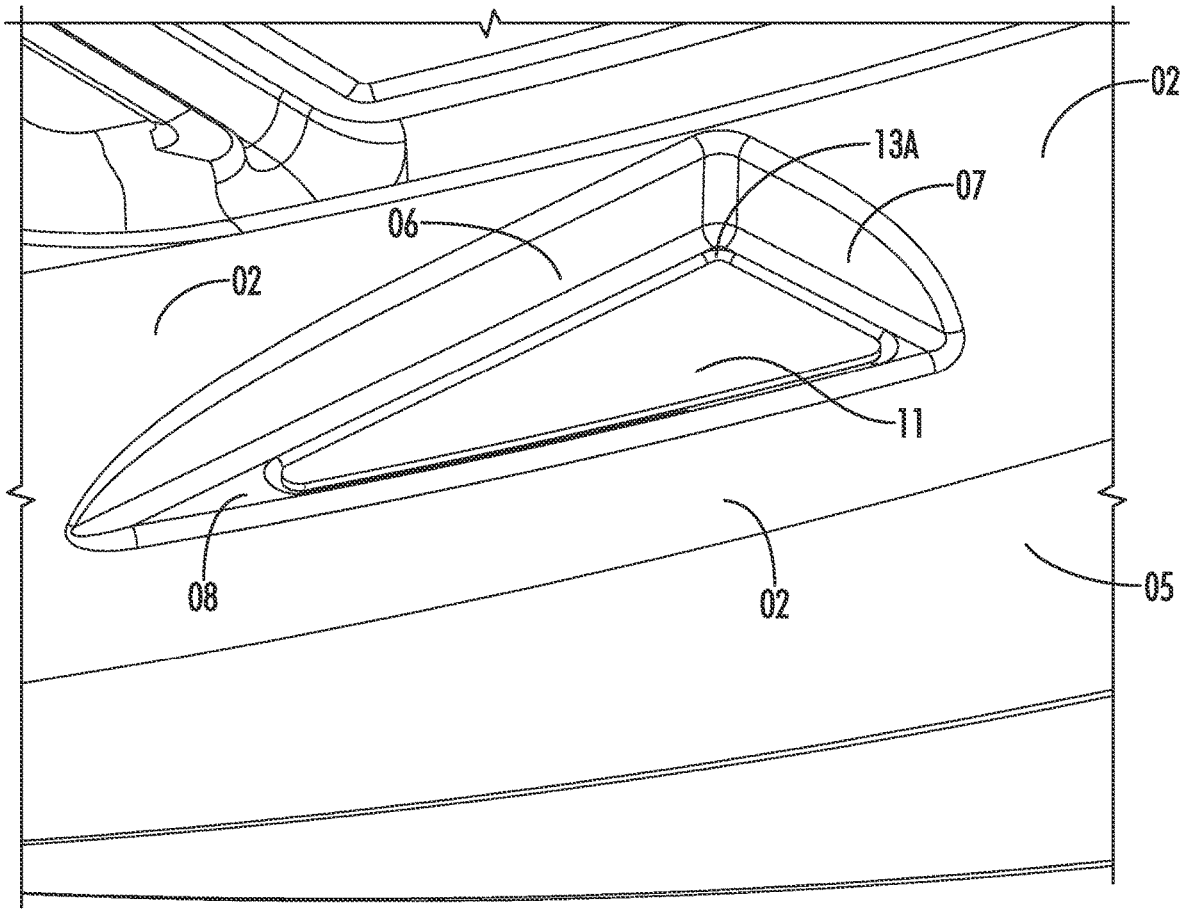
FIG. 19 is the same view as from FIG. 18, but this time with the cover plate shown.

FIG. 19 is the same view as FIG. 18, but this time with the cover plate 11 installed in secondary cavity 13 extending over the primary cavity 12. No hole has been drilled into the cover plate 11 for receiving and attaching the navigation light as it would, in practice, be based on the unique aspects of the selected navigation light. The cover plate 11 can be secured to the plastic either via fasteners, glue, or a combination thereof.

Figure 20:
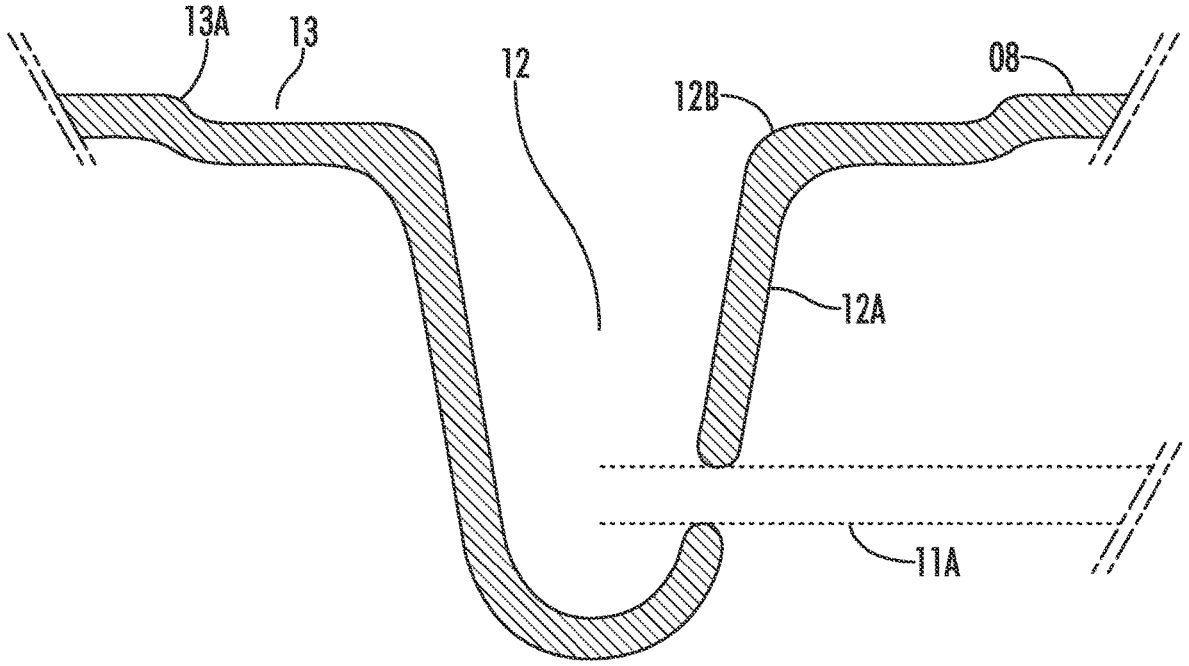
FIG. 20 is a cross-section view of the application of the present invention shown in FIGS. 18 & 19. Only the molded plastic is shown.

FIG. 20 is a detailed cross-section view of the trench in FIGS. 18 and 19 and is intended as a generic representation of the present invention as applied to the installation of navigation lights. While the primary cavity 12 provides a cavity for the protruding end and wires of the navigation light to install into, a means of running the wires out of the cavity must still be available. Numeral 11A represents a notional apparatus used to create a penetration (i.e. hole) in the plastic wall 12A. This hole can be created during the molding processing using inserts, or drilled after the boat is molded and allows a means of running the navigation light cables out of the primary cavity 12 through the hole and into a nearby cable chase, such as the one depicted in FIG. 15, for connection to the boat's electrical system.

Figure 21:
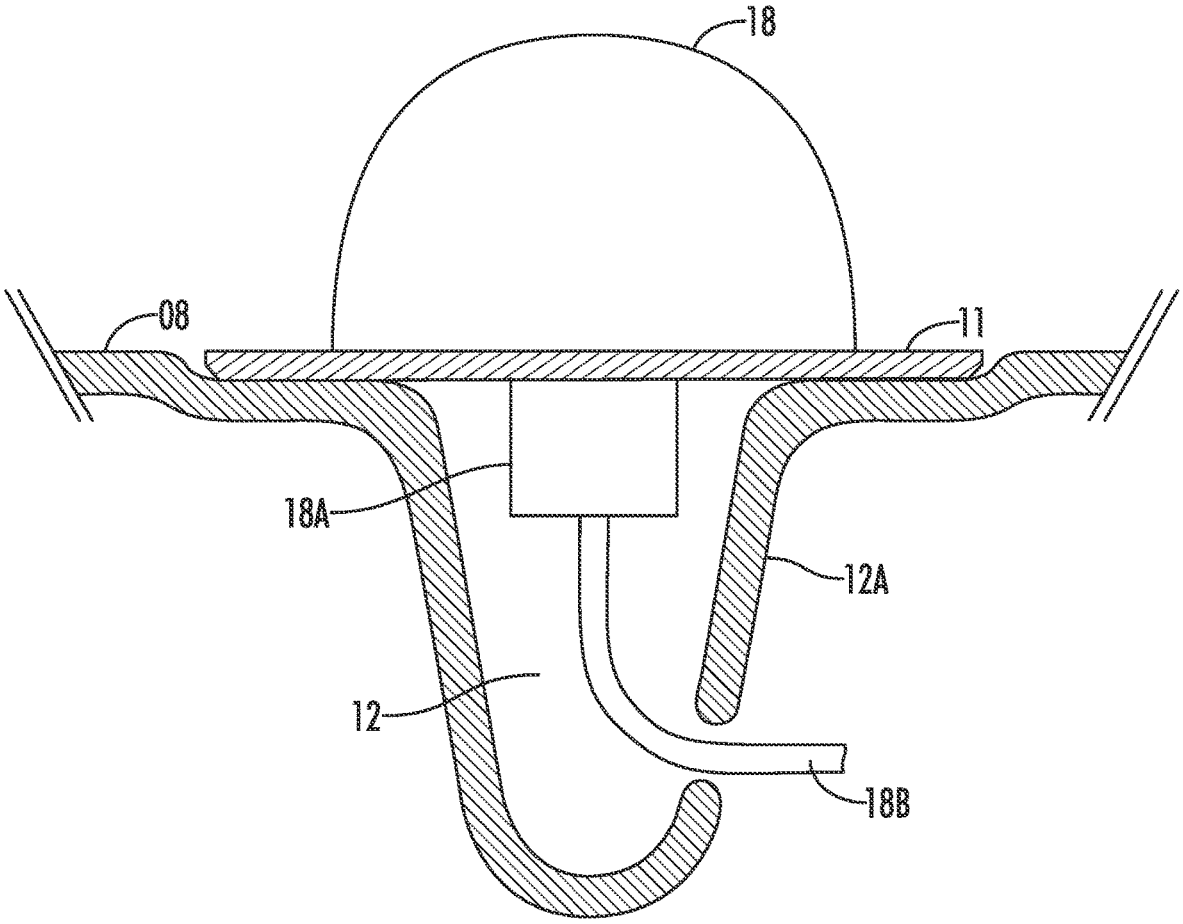
FIG. 21 is the same view as from FIG. 20, but with the cover plate and notional navigation light shown, along with a notional electrical wire leading out from the navigation light, demonstrating how the primary cavity enables the installation of the navigation light.

FIG. 21 is the same cross-section view as FIG. 20, but this time showing the cover plate 11 and a notional navigation light 18. The protruding end of navigation light 18 is represented generally by numeral 18A, whereas a notional wire extending out from 18A and through the hole in 12A is represented by numeral 18B.

Figure 22:
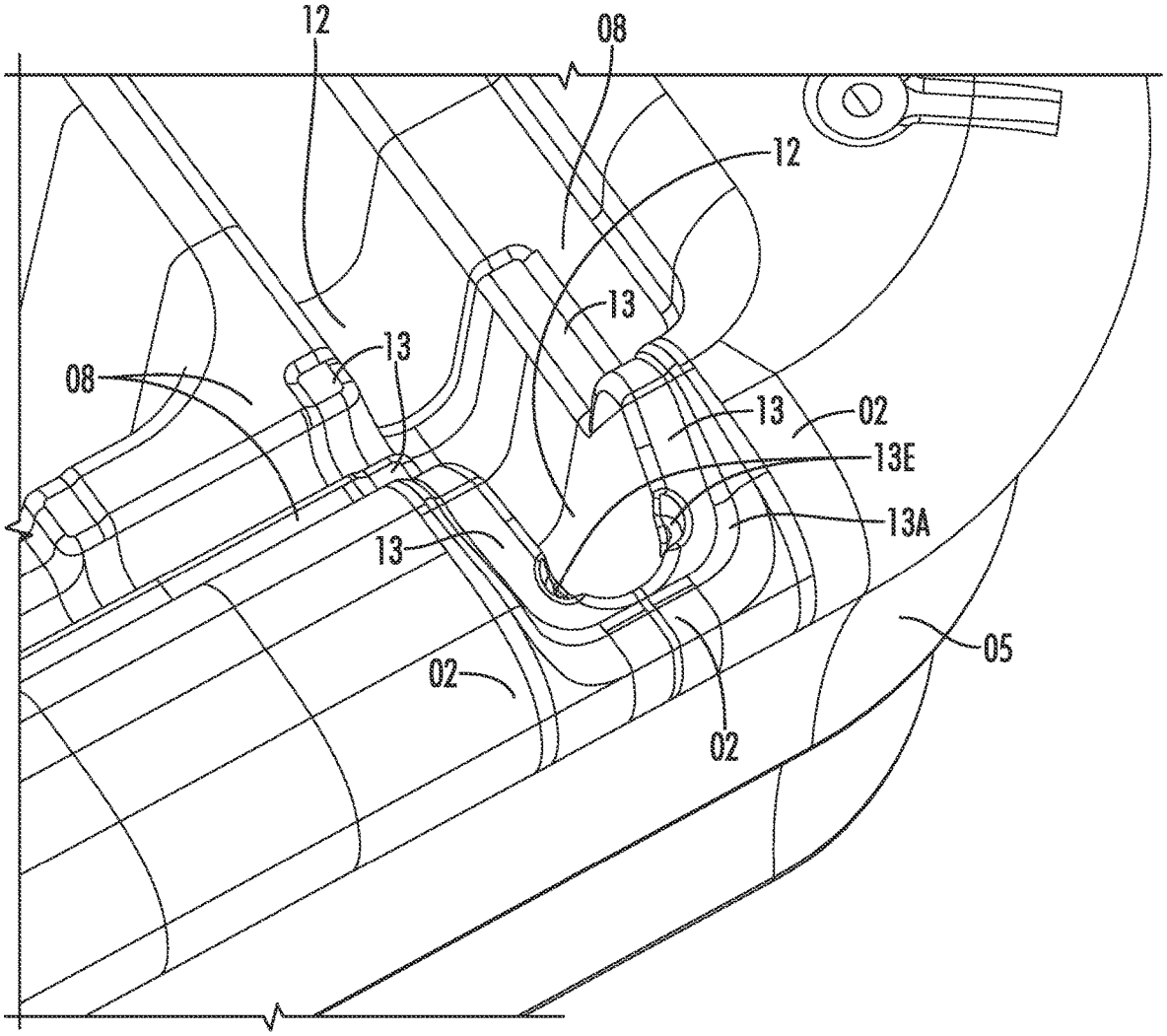
FIG. 22 is a close-up perspective view of a specific application of the present invention, in this case, enabling the installation of a fuel fill cap (for a permanent fuel tank), or any other such flanged fitting (such as for an electrical receptacle) along the aft gunwale of the boat, as is typical for a conventional boat built of aluminum or FRP. This particular depiction highlights the manner in which both the trench for the fuel fill cap is molded into the gunwale, along with the continuation of the molded-in trench for the installation of the fuel hose. Only the molded plastic is shown.

In FIG. 22, an application of the present invention to the installation of an industry standard fuel fill cap and hose in the port gunwale 02 is depicted. This application could also be generically applied to other industry standard outfitting items, such as electrical receptacles or thru-hull fittings designed for mounting in a hole. In this view, only the molded plastic is shown, and the view is from outside the boat looking toward the port gunwale 02. The primary cavity 12 of the trench is molded into the port gunwale 02 and provides a chase for the fuel fill hose while the secondary cavity 13 provides a surface to mount the cover plate to which the fuel fill cap itself can be mounted. Two shallow, circular cavities are shown in the secondary cavity 13. These cavities, represented generally by numeral 13E, are located based on the bolt pattern of the fuel fill cap's flange and provide space for the nuts and washers on the underside of the cover plate. The cover plate 11 can be secured to the plastic using fasteners, glue, or any combination thereof.

Figure 23:
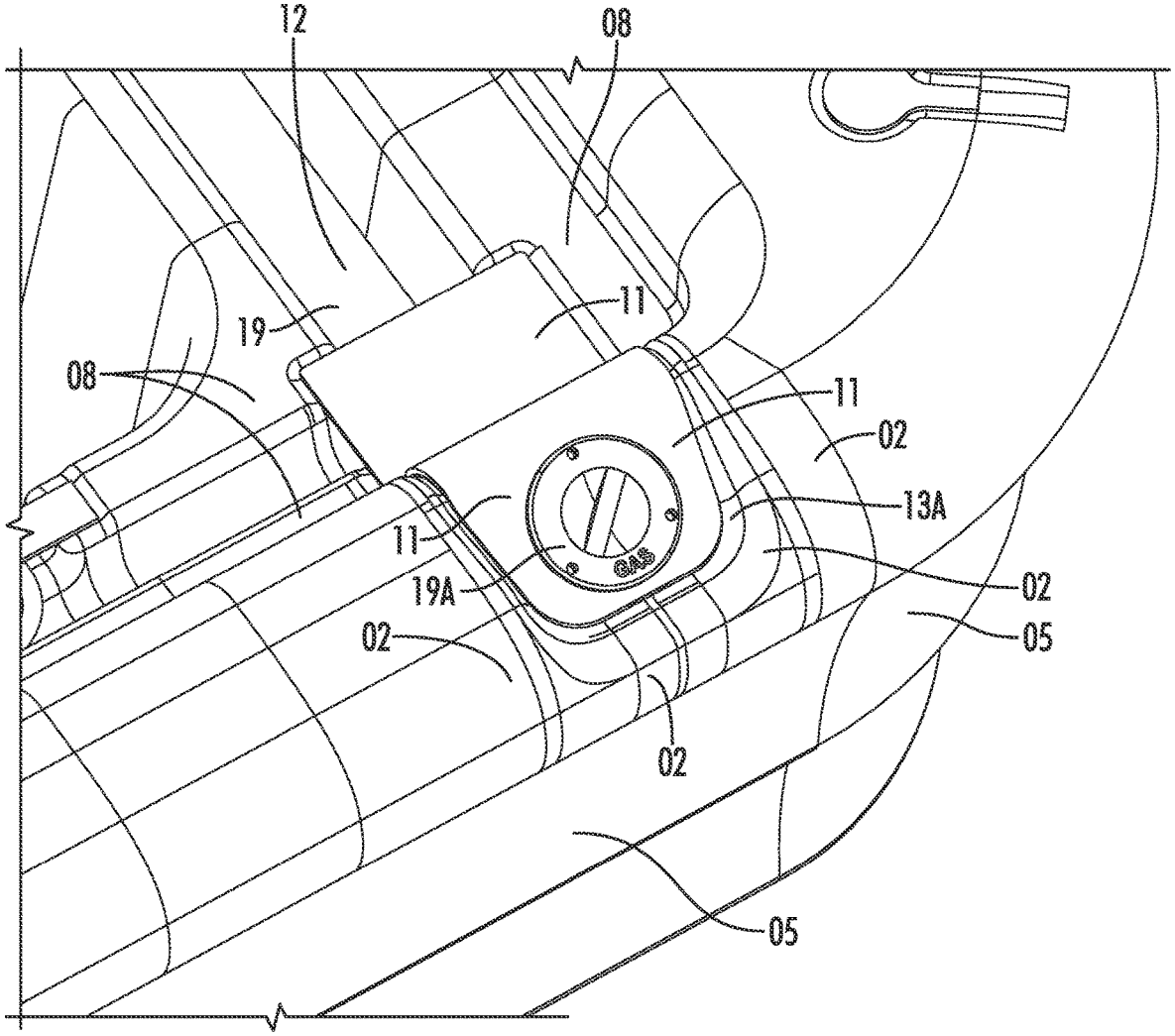
FIG. 23 is the same view from FIG. 22, but this time with the cover plate, notional fuel fill cap, and notional fuel hose shown.

FIG. 23 is the same view as FIG. 22, but this time the cover plate 11, fuel fill cap, and fuel hose are shown. The fuel hose is indicated generally by numeral 19 and the fuel fill cap is indicated generally by numeral 19A. The cover plate 11 is designed to conform to the shape of the secondary cavity 13 and be flush with the surrounding plastic. In addition, the cover plate 11 not only provides a mounting surface for the fuel fill cap 19A, but also acts as a tie-down for the fuel fill hose 19 as the hose makes a relatively tight bend off of the fuel fill cap 19A.

Figure 24:
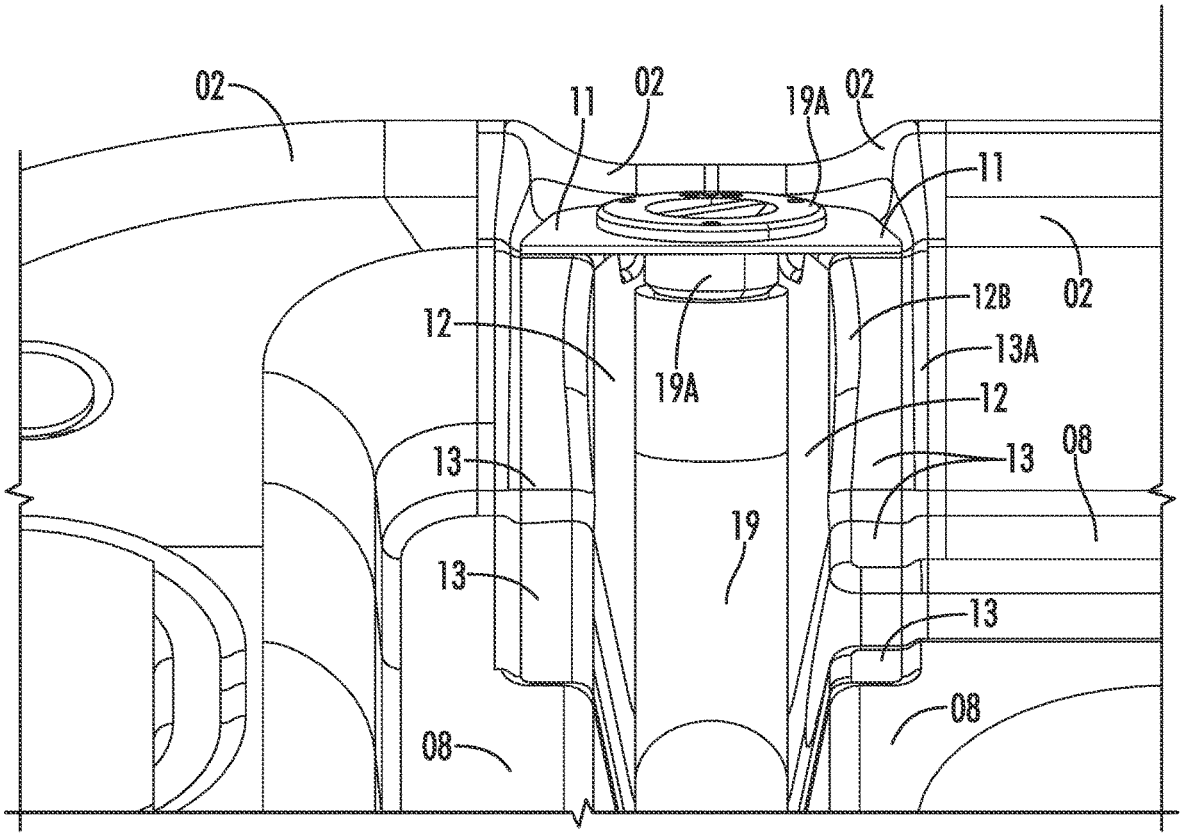
FIG. 24 is another perspective of the fuel fill cap & hose trench from FIGS. 22 & 23, but from the opposite side (inside the boat looking toward the port gunwale). Part of the cover plate has been removed to better illustrate the manner in which the trench and cover plate facilitate the installation of the fuel fill cap and hose.

FIG. 24 is an alternate view of the trench depicted in FIGS. 22 & 23, but from inside the boat looking toward the port gunwale 02. A portion of the cover plate 11 has been removed to better illustrate the relationship between the plastic structure, the outfitting items, and the cover plates. With the fuel fill cap 19A securely fastened to the cover plate 11, the fuel fill hose 19 is able to run along the cavity 12.

Figure 25:
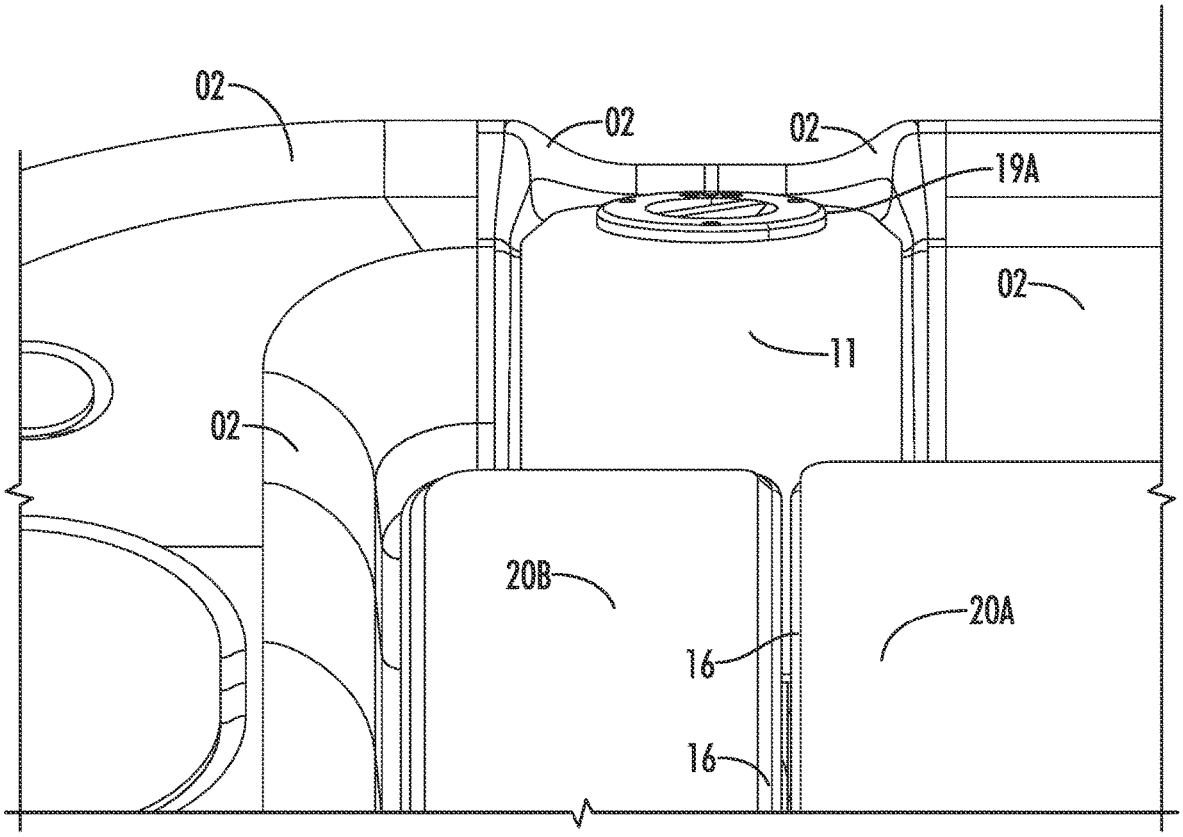
FIG. 25 is the same view as FIG. 24, but this time all cover plates, decks, and flooring material are shown.

FIG. 25 is the same view as FIG. 24, but this time all cover plates, decks, and flooring material are shown. In this figure, it is apparent how the unique construction of the present invention, once highly visible in FIGS. 22, 23, and 24, is successfully hidden by the decks and flooring material, resulting in the appearance of a continuous, flat deck. Only that portion of the cover plate 11 that lies beyond the decks 20A and 20B is visible. Since this is a relatively small portion of the cover plate 11 and conforms to the shape of the gunwale 02, a suitably attractive material or finish can be selected for this area of cover plate, such as painted, polished, or textured metal.

In view of the above illustrated embodiments and description, broadly speaking the present invention is the combination of male cavities and cover plates specifically utilized for running hoses, cables and installing industry standard equipment in a rotational molded boat in places that otherwise would not have a cavity or void available. For example, a deck panel installed over a conventional storage compartment would naturally have a void underneath, but the port and starboard sides of the boat, the gunwales, transverse walls, etc. would not normally have voids. The trench and plate system of the present invention therefore allows the strategic placement of hoses, cables and industry standard equipment in places where they normally could not go in a rotational molded boat. Additionally, the present invention does not rely on conveniently located boat structures, such as seat pedestals, to achieve this; rather, it relies on the plates to enable this "generic" placement of these structures. The secondary cavity further distinguishes the primary cavities from other random cavities with a covering on them that just so happens to be available for installing equipment. The present invention therefore provides specially purposed molded-in trenches which are covered by specially-fitted plates for the purpose of running hoses, cables and industry standard equipment, which is unique in the rotational molded boat industry.

While the present invention has been described at some length and with some particularly with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention.

What is claimed is:

1. A rotational-molded plastic power boat hull comprising:

a plurality of molded-in male cavities strategically located throughout the boat hull, said male cavities including a primary cavity section and a secondary cavity section adjacent the primary cavity section, the secondary cavity section positioned along a top of the male cavities; and a plurality of cover plates each dimensioned to be installed in the secondary cavity section of one of the molded-in male cavities extending over and covering at least a portion of the primary cavity section.

2. The rotational molded plastic power boat hull of claim 1 wherein the primary cavity section is of a depth and width determined by the purpose of the male cavity.

3. The rotational molded plastic power boat hull of claim 2 wherein the secondary cavity section is of a depth and width that allows one of the cover plates having a shape complementary to the secondary cavity section to be installed into the secondary cavity section supported on a mounting surface so that the cover plate is flush with surrounding plastic surfaces and/or does not obstruct surrounding structures of the boat hull.

4. The rotational molded plastic power boat hull of claim 3 wherein the molded-in male cavities facilitate the installation of electrical cables, hoses, and conduits.

5. The rotational molded plastic power boat hull of claim 3 wherein the molded-in male cavities facilitate the installation of commercial off-the-shelf boat outfitting items otherwise not designed for rotational molded boat hulls.

6. The rotational molded plastic power boat hull of claim 3 wherein the molded-in male cavities facilitate the covering of holes or voids in the plastic hull in areas visible to the boat's operator.

7. The rotational molded plastic power boat hull of claim 3 wherein the molded-in male cavities facilitate the covering of stiffening ribs and other molded-in male cavities that are to be hidden from sight.

8. The rotational molded plastic power boat hull of claim 3 wherein flush fitting of the cover plates extending over the tops of the molded-in male cavities in the plastic hull with adjacent plastic surfaces of the hull provides flush surfaces reminiscent of a boat constructed of aluminum or fiber reinforced plastic.

9. The rotational molded plastic power boat hull of claim 8 wherein the cover plates when secured in the secondary cavity sections act as tie-downs to hold hoses and cables in place, where the stiffness of the hoses and cables would otherwise force them out of the primary cavities.

10. The rotational molded plastic power boat hull of claim 9 wherein the secondary cavity sections provide a simple to install and aesthetically pleasing means of installing off-the-shelf boat outfitting items that otherwise are not designed for rotational molded boat hulls.

11. The rotational molded plastic power boat hull of claim 10 wherein the secondary cavity sections act as a simple to install and aesthetically pleasing means of providing support for flooring materials positioned over the tops of trenches formed by the male cavity sections in flat, horizontal surfaces.

12. The rotational molded plastic power boat hull of claim 11 wherein the cover plates in conjunction with the secondary cavity sections act as a simple to install and aesthetically pleasing means of covering up molded-in structures that are inherent to rotational molded boats, but would otherwise look out of place when compared to a non-rotational molded boat build of aluminum or fiber reinforced plastic (FRP).

13. A rotational molded plastic power boat hull comprising:

a plurality of rotational molded-in male cavities formed in a surface of the hull and strategically located throughout the boat; and a cover plate having a shape which is complementary to one of the molded-in male cavities, wherein when the cover plate is secured in the cavity an upwardly facing surface of the cover plate is either flush with the surrounding molded plastic or does not obstruct surrounding boat structures.

14. The rotational molded plastic power boat hull of claim 13 wherein at least one of the molded-in cavities includes a lower primary cavity section forming a bottom of a trench and an upper secondary cavity section forming a top of the trench having a cover plate receiving surface.

15. The rotational molded plastic power boat hull of claim 13 wherein the cover plates provide support for flooring material installed on top of the boat hull deck and cover plates.

16. A trench and plate boat hull system for rotational molded plastic-hulled power boats comprising:

one or more molded-in male cavities in the boat hull; and a complementary cover plate which is securable in at least one of the molded-in male cavities, wherein the cover plate is configured to provide continuity with immediately surrounding surfaces of the boat hull when the cover plate is secured over the molded-in cavity.

17. The trench and plate boat hull system of claim 16 wherein at least one of the male cavities is configured to receive a cable, hose, or conduit in the male cavity.

18. The trench and plate boat hull system of claim 16 wherein at least one of the male cavities is configured to receive a boat outfitting equipment item otherwise not designed for mounting on a rotational molded boat hull, and the cover plate provides a mounting surface for the equipment item.

19. The trench and plate boat hull system of claim 16 wherein a pressure vent hole or a foam or plastic powder filling loading port is formed in the male cavity, and the male cavity additionally comprises an extension for draining water.

20. The trench and plate boat hull system of claim 16 wherein at least one of the male cavities is a molded-in stiffening rib to prevent warping and sponginess of the boat hull deck.

* * * * *